US008256034B2

(12) United States Patent
Berner, Jr. et al.

(10) Patent No.: US 8,256,034 B2
(45) Date of Patent: Sep. 4, 2012

(54) ARTICLE OF APPAREL WITH INNER AND OUTER LAYER AND AN INSERT ELEMENT IN BETWEEN

(75) Inventors: William E. Berner, Jr., Portland, OR (US); James A. Niegowski, Portland, OR (US); Matthew F. Park, Portland, OR (US); Susan L. Sokolowaki, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 719 days.

(21) Appl. No.: 12/184,668

(22) Filed: Aug. 1, 2008

(65) Prior Publication Data

US 2010/0024101 A1 Feb. 4, 2010

(51) Int. Cl.
*A41D 13/015* (2006.01)

(52) U.S. Cl. ..... 2/455; 2/69; 2/227; 2/267

(58) Field of Classification Search ..... 2/244, 115, 2/80, 126, 23, 69, 108, 105, 106, 246, 49.1, 2/75, 247, 1, 22, 85, 93, 102, 227, 250, 251, 2/252, 245, 267, 466, 269, 270, 274
See application file for complete search history.

(56) References Cited

U.S. PATENT DOCUMENTS

| | | | | |
|---|---|---|---|---|
| 3,484,974 | A | 12/1969 | Culmone | |
| 3,950,789 | A | 4/1976 | Konz | |
| 4,249,268 | A | 2/1981 | Berler | |
| 4,287,250 | A * | 9/1981 | Rudy | 428/166 |
| 4,345,958 | A | 8/1982 | Kuroda | |
| 4,384,369 | A | 5/1983 | Prince | |
| 4,407,497 | A | 10/1983 | Gracie | |
| 4,696,066 | A | 9/1987 | Ball | |
| 4,815,149 | A | 3/1989 | Erhardt et al. | |
| 5,034,998 | A | 7/1991 | Kolsky | |
| 5,048,123 | A | 9/1991 | Monson | |
| 5,048,125 | A * | 9/1991 | Libertini et al. | 2/79 |

(Continued)

FOREIGN PATENT DOCUMENTS

DE 102005060624 5/2007

(Continued)

OTHER PUBLICATIONS

International Search Report and Written Opinion for PCT/US2009/50860, mailed on Jan. 26, 2010.

(Continued)

*Primary Examiner* — Khoa Huynh
*Assistant Examiner* — Khaled Annis
(74) *Attorney, Agent, or Firm* — Plumsea Law Group, LLC

(57) ABSTRACT

An apparel system may include an article of apparel and at least one insert element. The apparel has an inner layer and an outer layer positioned adjacent to the inner layer such that a surface of the inner layer contacts a surface of the outer layer. The insert elements is locatable between the inner layer and the outer layer. In some configurations, the outer layer stretches at least thirty percent prior to tensile failure. In order to secure the insert element within the apparel, a coefficient of static friction between the insert element and the apparel may be at least 0.70. In some configurations, a surface of the inner layer contacts and is unsecured to a surface of the outer layer in at least thirty percent of the apparel.

26 Claims, 19 Drawing Sheets

U.S. PATENT DOCUMENTS

| | | | | |
|---|---|---|---|---|
| 5,054,127 | A | 10/1991 | Zevchak | |
| 5,136,726 | A | 8/1992 | Kellin et al. | |
| 5,274,846 | A | 1/1994 | Kolsky | |
| 5,334,082 | A * | 8/1994 | Barker | 450/31 |
| 5,427,563 | A * | 6/1995 | Manning | 450/79 |
| 5,454,743 | A | 10/1995 | Simonson | |
| 5,484,448 | A | 1/1996 | Steele | |
| 5,536,246 | A | 7/1996 | Saunders | |
| 5,539,934 | A | 7/1996 | Ponder | |
| 5,636,377 | A | 6/1997 | Wiener | |
| 5,659,898 | A | 8/1997 | Bell, Jr. | |
| 5,729,832 | A | 3/1998 | Grilliot et al. | |
| 5,734,991 | A | 4/1998 | Schmid | |
| 5,742,939 | A | 4/1998 | Williams | |
| 5,826,273 | A | 10/1998 | Eckes | |
| 5,860,163 | A * | 1/1999 | Aldridge | 2/81 |
| 5,953,757 | A | 9/1999 | Blanks | |
| 5,957,692 | A | 9/1999 | McCracken et al. | |
| 6,005,222 | A | 12/1999 | Hicks | |
| 6,041,436 | A | 3/2000 | Keen | |
| 6,098,198 | A | 8/2000 | Jacobs et al. | |
| 6,139,928 | A | 10/2000 | Sloot | |
| 6,193,678 | B1 | 2/2001 | Brannon | |
| 6,228,108 | B1 | 5/2001 | Lamb | |
| 6,289,524 | B1 | 9/2001 | Wright et al. | |
| 6,295,654 | B1 * | 10/2001 | Farrell | 2/456 |
| 6,453,477 | B1 * | 9/2002 | Bainbridge et al. | 2/455 |
| 6,484,325 | B1 | 11/2002 | Lazarus et al. | |
| 6,519,781 | B1 | 2/2003 | Berns | |
| 6,666,836 | B1 | 12/2003 | Islava | |
| 6,842,915 | B2 | 1/2005 | Turner et al. | |
| 6,936,021 | B1 | 8/2005 | Smith | |
| 6,982,115 | B2 | 1/2006 | Poulos et al. | |
| 7,065,793 | B1 | 6/2006 | Wooten | |
| 7,276,076 | B2 | 10/2007 | Bieberich | |
| 7,389,547 | B1 | 6/2008 | Wiens | |
| 2002/0184925 | A1 | 12/2002 | McClellan et al. | |
| 2003/0070209 | A1 | 4/2003 | Falone | |
| 2003/0220048 | A1 * | 11/2003 | Toro et al. | 450/57 |
| 2003/0236053 | A1 * | 12/2003 | Martz | 450/39 |
| 2004/0019950 | A1 * | 2/2004 | Rast | 2/77 |
| 2005/0009445 | A1 * | 1/2005 | Bell et al. | 450/1 |
| 2005/0066407 | A1 | 3/2005 | Delaney | |
| 2005/0085162 | A1 | 4/2005 | Ott | |
| 2005/0229282 | A1 | 10/2005 | Davis | |
| 2005/0278817 | A1 | 12/2005 | Doheny | |
| 2006/0025039 | A1 * | 2/2006 | Barbour et al. | 450/1 |
| 2006/0099884 | A1 | 5/2006 | Falla | |
| 2006/0218692 | A1 | 10/2006 | Lamarque | |
| 2006/0277647 | A1 | 12/2006 | Dobkin | |
| 2007/0106352 | A1 | 5/2007 | Carstens | |
| 2007/0185425 | A1 | 8/2007 | Einarsson et al. | |
| 2007/0186327 | A1 | 8/2007 | Hall et al. | |
| 2007/0186328 | A1 * | 8/2007 | Bulian | 2/69 |
| 2007/0250976 | A1 | 11/2007 | Beliveau | |
| 2008/0040831 | A1 * | 2/2008 | Nilforushan et al. | 2/69 |
| 2008/0060113 | A1 | 3/2008 | Walsh | |

FOREIGN PATENT DOCUMENTS

| | | |
|---|---|---|
| EP | 0962156 | 12/1999 |
| EP | 1872676 | 1/2008 |
| JP | 2004156199 | 6/2004 |
| WO | WO2004019713 | 3/2004 |

OTHER PUBLICATIONS

International Search Report and Written Opinion for PCT/US2009/050862, mailed Dec. 8, 2009.

* cited by examiner

ARTICLE OF APPAREL WITH INNER AND OUTER LAYER AND AN INSERT ELEMENT IN BETWEEN

BACKGROUND

Articles of apparel intended for use during athletic activities generally exhibit characteristics that enhance the performance, comfort, or protection of a wearer. As an example, apparel may incorporate a stretch material that provides a relatively tight fit, thereby imparting the wearer with a lower profile that minimizes wind resistance. Apparel may also be formed from a material that wicks moisture away from the wearer in order to reduce the quantity of perspiration that accumulates adjacent to the skin. Furthermore, apparel may incorporate materials that attenuate compression forces (i.e., impart padding or cushioning) to provide impact protection to areas of the wearer. Apparel may also incorporate elements that are heated or cooled to impart heat to the wearer or draw heat away from the wearer. Accordingly, the configurations of articles of apparel for athletic activities may be specifically selected to enhance the performance or comfort of the wearer.

SUMMARY

Various apparel systems are disclosed below as including an article of apparel and at least one insert element. The apparel has an inner layer and an outer layer positioned adjacent to the inner layer such that a surface of the inner layer contacts a surface of the outer layer. The insert element is locatable between the inner layer and the outer layer. In some configurations, the outer layer stretches at least thirty percent prior to tensile failure. In order to secure the insert element within the apparel, a coefficient of static friction between the insert element and the apparel may be at least 0.70. In some configurations, a surface of the inner layer contacts and is unsecured to a surface of the outer layer in at least thirty percent of the apparel.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose concepts associated with various articles of apparel and insert elements.

Apparel System Configuration

Figure 1:
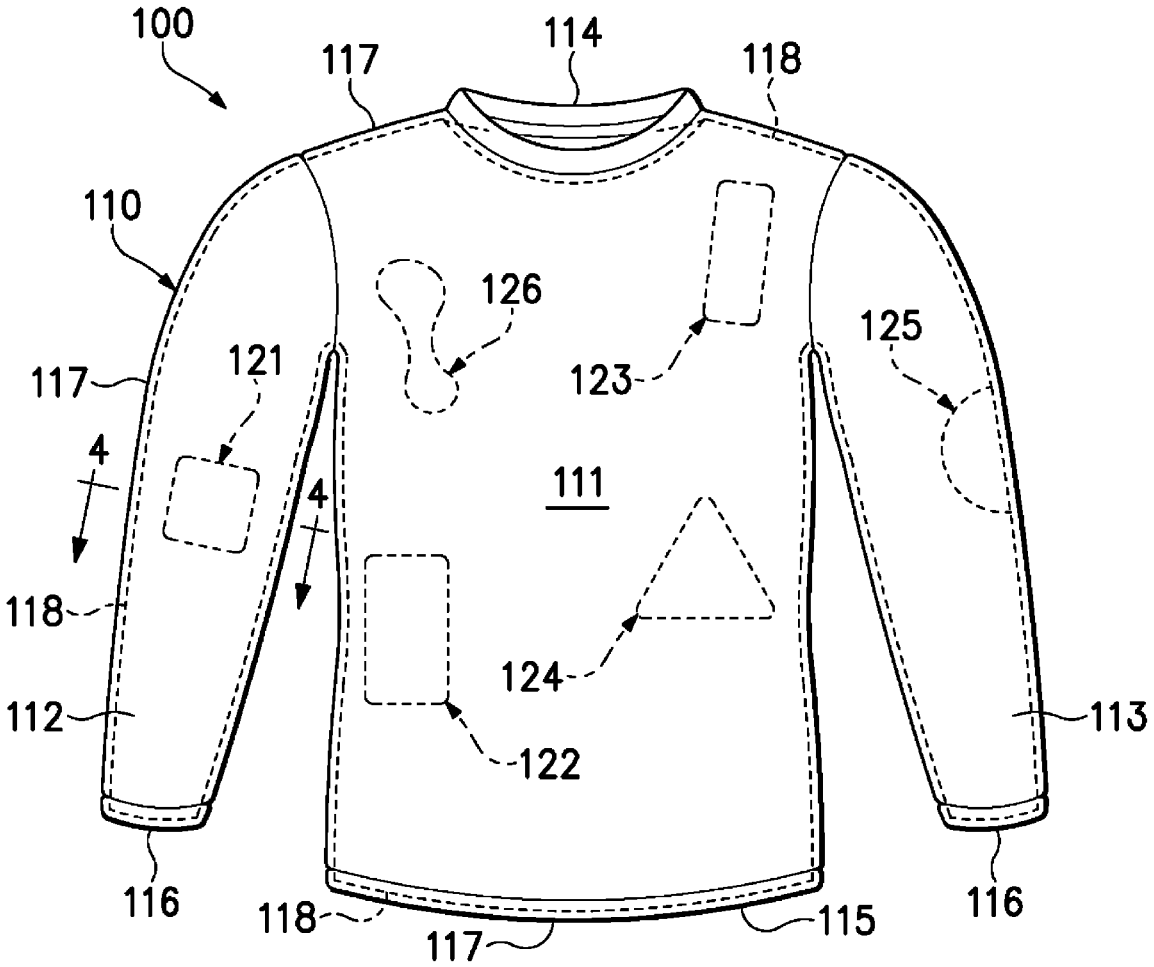
FIGS. 1-3 are front elevational views of an apparel system that includes an article of apparel and various insert elements.
Figure 2:
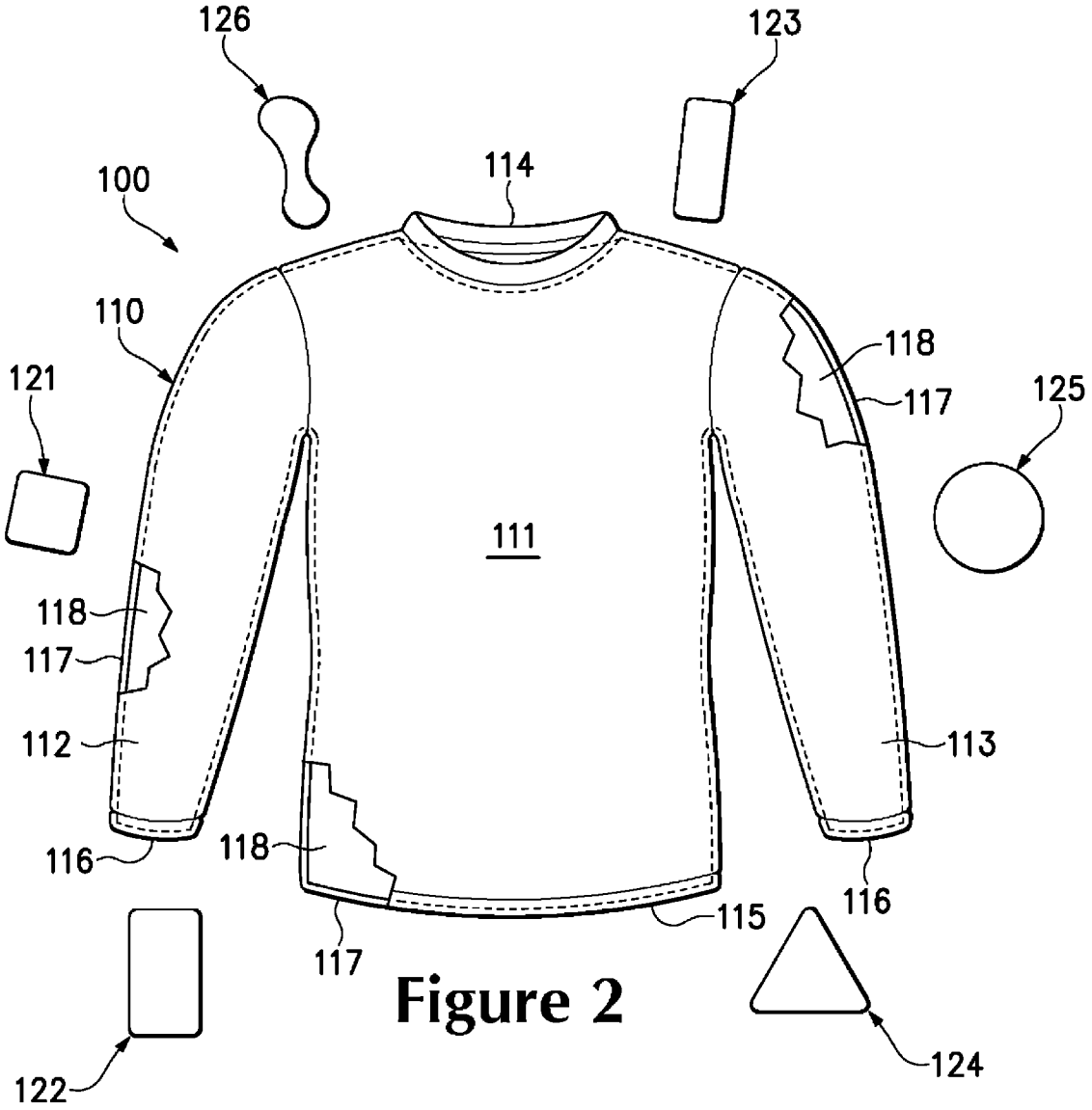
Figure 3:
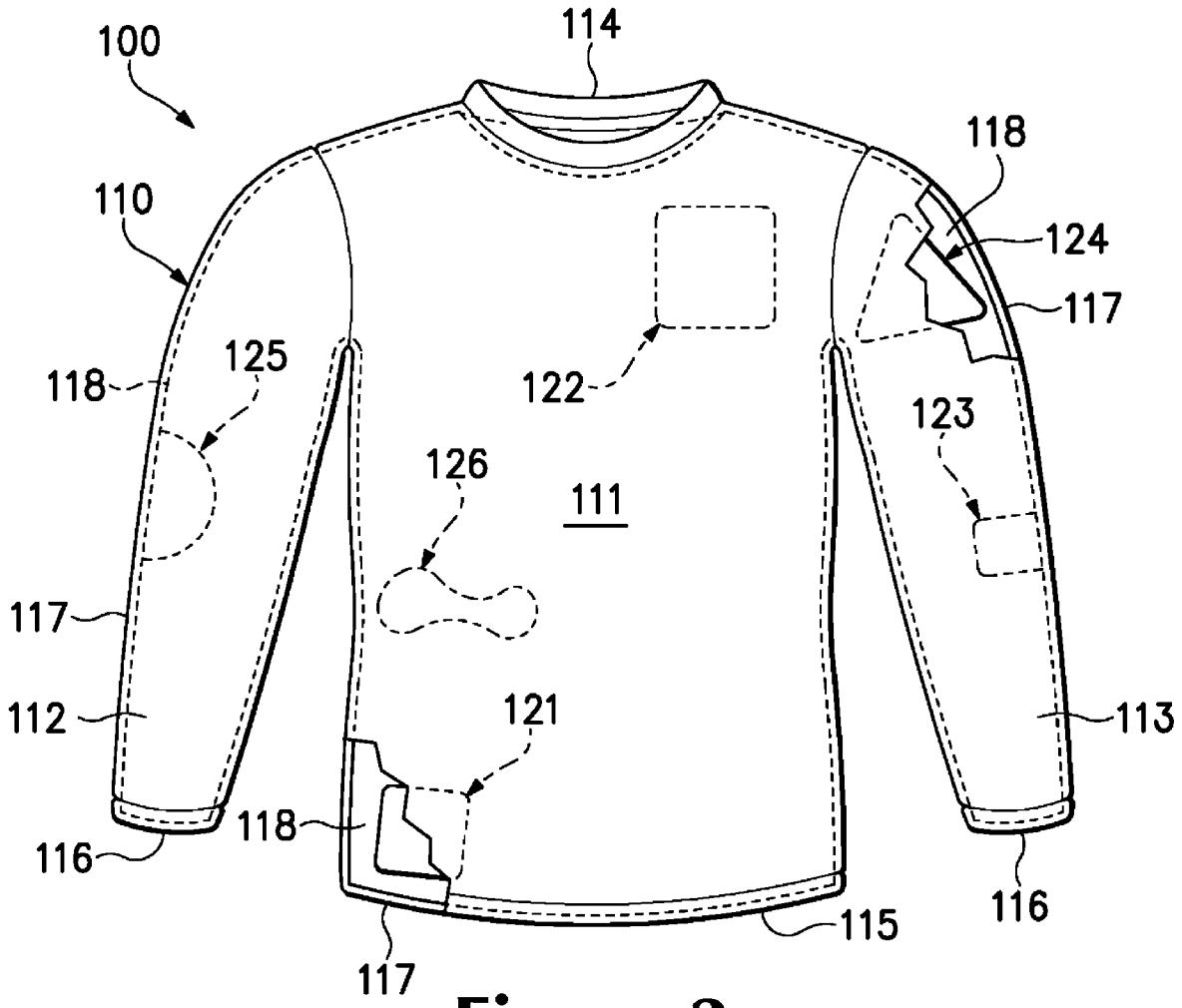

An apparel system 100 is depicted in FIG. 1 as having an article of apparel 110 and a plurality of insert elements 121-126. In general, apparel 110 has the configuration of a shirt-type garment that covers a torso and arms of a wearer, and insert elements 121-126 are joined with apparel 110 in various locations. Insert elements 121-126 may be any of, for example, (a) foam members, gas-filled chambers, or plates that attenuate compression forces (i.e., impart padding or cushioning) to provide impact protection to areas of the wearer where the insert elements are located, (b) liquid-filled chambers that impart either heating or cooling to areas of the wearer where the insert elements are located, or (c) electronic devices that provide information or enjoyment to the wearer, such as, mobile phones, portable music players, timing devices, heart-rate monitors, locator beacons, global positioning systems, or mobile computing devices. Given that the wearer may desire to have compression force attenuation, heating or cooling, or electronic devices positioned in various locations on the body, each of insert elements 121-126 may be removed from apparel 110, as depicted in FIG. 2, and positioned in different locations, as depicted in FIG. 3. Accordingly, each of insert elements 121-126 may be relocated depending upon the particular function of each of insert elements 121-126 and the desires, needs, or preferences of the wearer. Although six insert elements 121-126 are depicted for purposes of example, the number of insert elements utilized with apparel 110 may range from one to thirty or more.

Apparel 110 includes a torso region 111 and a pair of arm regions 112 and 113 that extend outward from torso region 111. Torso region 111 corresponds with a torso of a wearer and covers at least a portion of the torso when worn. An upper area of torso region 111 defines a neck opening 114 through which the neck and head of the wearer protrude when apparel 110 is worn. Similarly, a lower area of torso region 111 defines a waist opening 115 through which the waist or pelvic area of the wearer protrudes when apparel 110 is worn. Arm region 112 corresponds with a right arm of the wearer and covers at least a portion of the right arm, and arm region 113 corresponds with a left arm of the wearer and covers at least a portion of the left arm. Each of arm regions 112 and 113 define a wrist opening 116 through which a hand and wrist of the wearer protrude when apparel 110 is worn.

Figure 4:
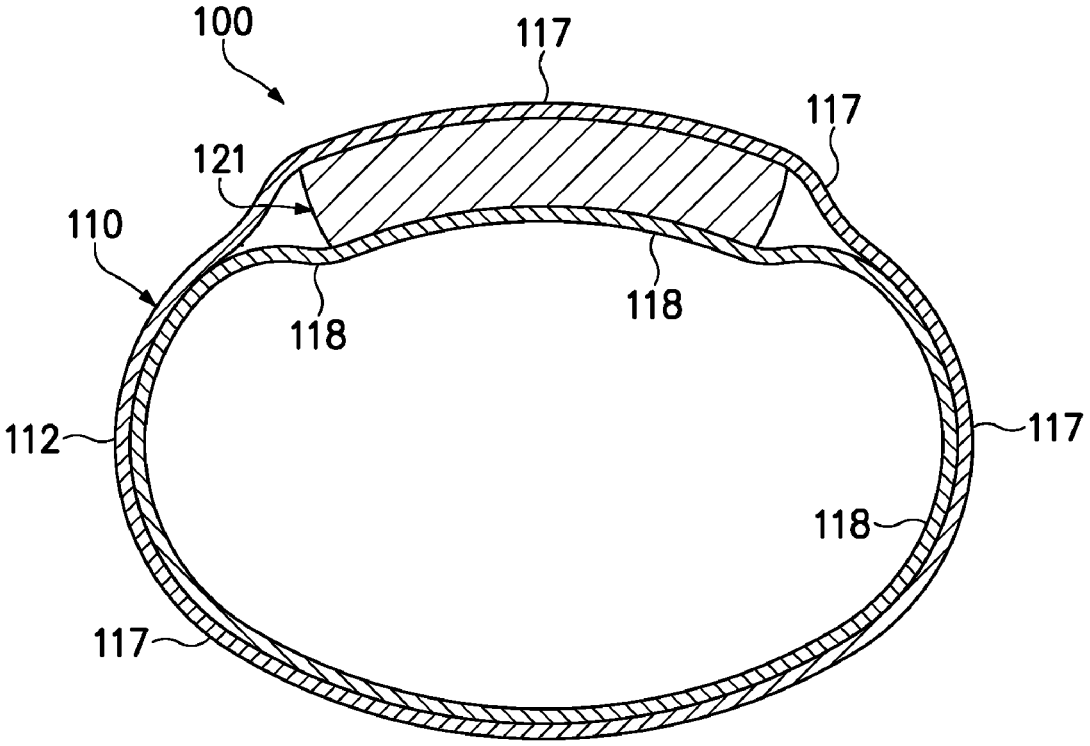
FIG. 4 is a cross-sectional view of the apparel system, as defined by section line 4-4 in FIG. 1.

Apparel 110 exhibits a two-layer configuration having an outer layer 117 and an adjacent inner layer 118 that extend through each of regions 111-113. Outer layer 117 forms an outer portion of apparel 110 and defines a majority of an exterior surface of apparel 110. Inner layer 118 forms an inner portion of apparel 110 and defines a majority of an inner surface of apparel 110 that may contact the wearer when apparel 110 is worn. Although outer layer 117 and inner layer 118 may be joined in various locations (e.g., through stitching), a majority of layers 117 and 118 are unconnected to each other and lay adjacent to each other, thereby defining areas for receiving insert elements 121-126. That is, insert elements 121-126 may be positioned between unconnected areas of layers 117 and 118, as depicted in FIG. 4. More particularly, insert elements 121-126 may be secured to apparel 110 when placed between layers 117 and 118, and insert elements 121-126 may be located in any of torso region 101 and arm regions 102 and 103.

A variety of materials may be utilized in manufacturing apparel 110. In general, apparel 110 may be formed from knitted, woven, or non-woven textile materials that include rayon, nylon, polyester, polyacrylic, cotton, wool, or silk, for example. Although apparel 110 may be knitted as a unitary (i.e., one-piece) article, apparel 110 may also be formed from a plurality of textile elements that are sewn, bonded, adhered, or otherwise joined together to form torso region 111 and arm regions 112 and 113. In some configurations, the textile materials may include coatings that form a breathable and water-resistant barrier, or polymer sheets may be utilized in place of textile materials. Apparel 110 may also be formed from laminated or otherwise layered materials that include two or more layers of textile materials, polymer sheets, or combinations of textile materials and polymer sheets. Although layers 117 and 118 may be formed from different textile materials, layers 117 and 118 may also be formed from substantially identical textile materials. That is, the textile material forming outer layer 117 may be the same as the textile material forming inner layer 118.

Apparel 110 is depicted as having the configuration of a shirt-type garment, particularly a long-sleeved shirt. In some configurations, apparel 110 may be intended for use as a compression garment. In addition to therapeutic uses, compression garments are often worn by athletes as a base layer under jerseys or other athletic apparel. In general, compression garments or other garments intended as base layers (a) exhibit a relatively tight fit that lays adjacent to the skin of the wearer and (b) stretch to conform with the contours of the wearer. While the textile materials forming compression garments may have one-directional stretch of, for example, more than ten percent prior to tensile failure, the textile materials forming other compression garments have two-directional stretch of at least thirty percent prior to tensile failure. Accordingly, when apparel 110 is formed to have a relatively tight fit and to stretch to conform with the contours of the wearer, the textile materials forming apparel 110 may have two-directional stretch of at least thirty percent prior to tensile failure.

Insert elements 121-126 may have a variety of configurations. When formed as foam members, gas-filled chambers, or plates, insert elements 121-126 may be utilized to attenuate compression forces (i.e., impart padding or cushioning). During athletic activities (e.g., practice sessions or competitions), for example, insert elements 121-126 may be utilized to provide impact protection to areas of the wearer. That is, insert elements 121-126 may be utilized to protect the wearer from impacts with other athletes, equipment, or the ground. When formed as liquid-filled chambers, insert elements 121-126 may impart either heating or cooling to areas of the wearer. As examples, cooling may be used prior to engaging in an athletic activity to moderate the core temperature of the wearer, and heating and cooling may be used to assist in recovering from injuries or soreness following athletic activity. When formed as electronic devices, insert elements 121-126 may be utilized to provide information or enjoyment to the wearer.

In addition to the materials utilized for insert elements 121-126, the shapes and sizes of attachment elements 121-126 may vary significantly. For example, insert elements 121 and 122 exhibit generally square configurations, with insert element 122 being larger than insert element 121 to cover a greater area of the wearer. Whereas insert element 123 has an elongate and rectangular shape, insert element 124 is triangular and insert element 125 is circular. Although insert elements 121-125 each have geometrical shapes, insert element 126 has an undefined and non-geometrical shape. The thicknesses of insert elements 121-126 may also vary significantly to include generally flat, non-uniform, tapered, or protruding configurations, depending upon the composition and intended use of insert elements 121-126. Accordingly, the general shapes and sizes of insert elements 121-126 may vary significantly.

Insert elements 121-126 may be selected and positioned based upon various factors, including their particular functions and the desires, needs, or preferences of the wearer. With respect to FIG. 1, for example, insert element 121 may be selected to be a foam member that imparts protection to a right elbow area of the wearer. Although similarly-shaped, insert element 122 may be a liquid-filled chamber that imparts cooling to a side torso area of the wearer. Each of insert elements 123 and 124 may be electronic devices (e.g., a mobile phone and a portable music player) that are secured to the torso area. Insert element 125 may be a liquid-filled chamber that imparts heating to a left elbow area of the wearer. Additionally, insert element 126 may be a gas-filled chamber that imparts protection to an upper torso area of the wearer. Each of insert elements 121-126 may therefore, be formed to have different configurations and positioned in different areas of the wearer to impart different functions to those areas.

A variety of attributes of apparel 110 and insert elements 121-126 may be utilized to securely-position insert elements 121-126. As examples, the positions of insert elements 121-126 may be secured through one or more of (a) frictional resistance between insert elements 121-126 and surfaces of layers 117 and 118, (b) compression forces from at least outer layer 117, and (c) a fastening system incorporated into one or more of insert elements 121-126 and surfaces of layers 117 and 118.

Figure 5A:
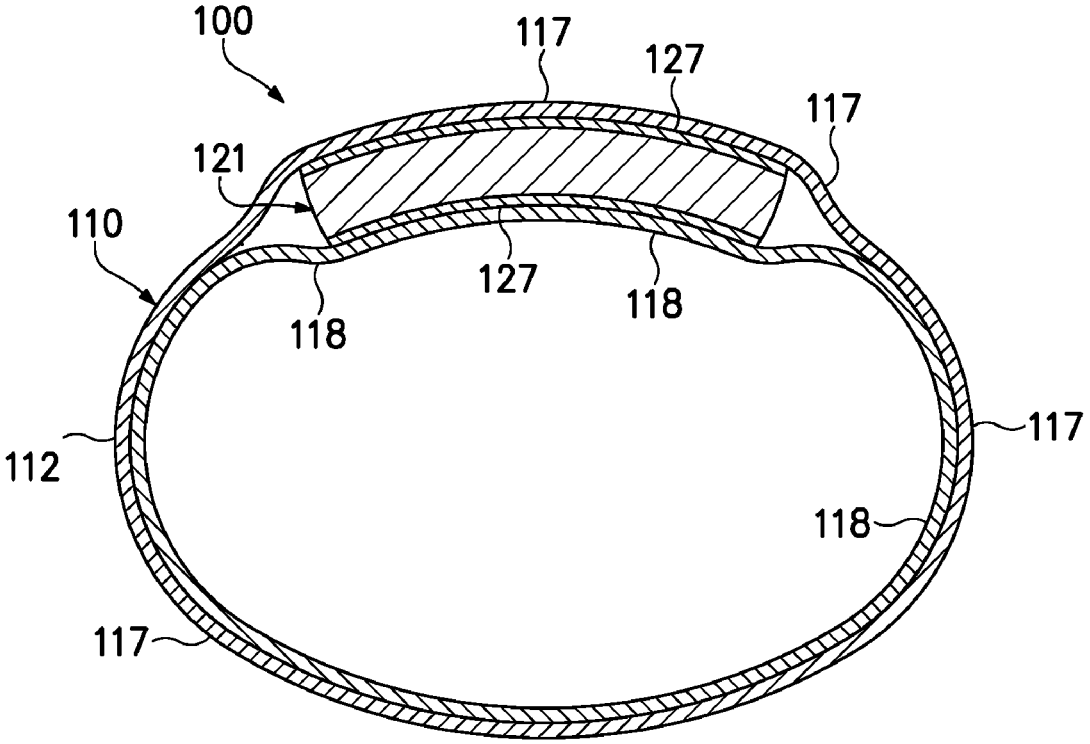
FIGS. 5A-5C are cross-sectional views corresponding with FIG. 4 and depicting further configurations of the apparel system.
Figure 5B:
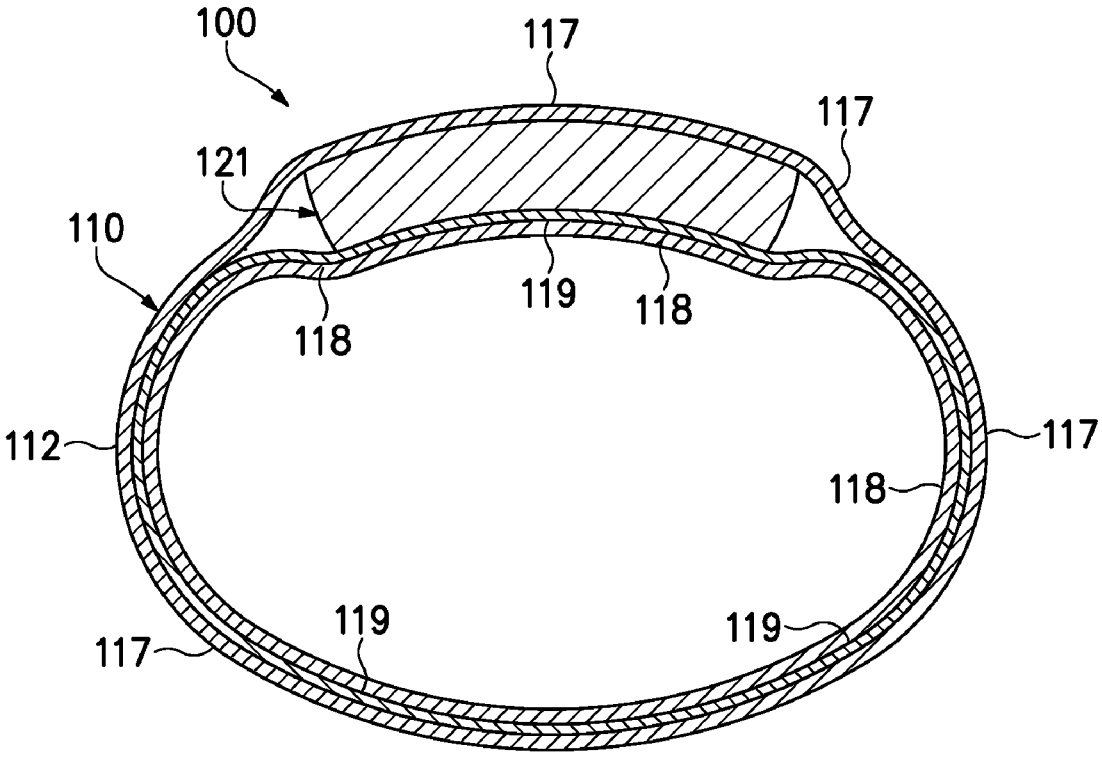

Frictional resistance between insert elements 121-126 and surfaces of layers 117 and 118 may be utilized to secure the positions of insert elements 121-126 within apparel 110. As noted above, insert elements 121-126 may be any of foam members, fluid-filled chambers (e.g., gas-filled or liquid-filled), plates, or electronic devices, for example. As such, insert elements 121-126 may be formed from a variety of materials, including polymer foams, polymer sheets, molded or cast polymer elements, metals, or textile elements, for example. Also as noted above, apparel 110 may be formed from knitted, woven, or non-woven textile materials, or may be formed from polymer sheets. Depending upon the materials selected for insert elements 121-126 and each of layers 117 and 118, friction may be sufficient to secure the positions of insert elements 121-126. In some configurations, various coatings (e.g., silicone or rubber) may be incorporated into surfaces of insert elements 121-126 or layers 117 and 118 in order to enhance the frictional resistance. Referring to FIG. 5A, insert element 121 is depicted as incorporating a coating 127 on opposite surfaces that increases the frictional resistance with each of layers 117 and 118. Referring to FIG. 5B, inner layer 118 is depicted as incorporating a coating 119 that increases the frictional resistance with one side of insert element 121. Depending upon the masses of each of insert elements 121-126 and the activity that a wearer engages in while wearing apparel 110, a coefficient of static friction of at least 0.70 between the exterior surfaces of insert elements 121-126 and at least one of the surface of layers 117 and 118 may be sufficient to securely-position insert elements 121-126 within apparel 110.

Compression forces may also be utilized to secure the positions of insert elements 121-126. As noted above, apparel 110 may be intended for use as a compression garment with a relatively tight fit that stretches (e.g., at least thirty percent prior to tensile failure) to conform with the contours of the wearer. When outer layer 117 stretches, outer layer 117 is placed in tension and applies a compression force to the wearer, as well as to each of insert elements 121-126. In general, the force necessary to overcome friction (i.e., the force that moves insert elements 121-126) is at least partially dependent upon the degree to which insert elements 121-126 and layers 117 and 118 are compressed together. As the compressive force from outer layer 117 increases, therefore, the positions of insert elements 121-126 become more secure. Accordingly, compression forces from at least outer layer 117 may also be utilized to secure the positions of insert elements 121-126 within apparel 110.

Figure 5C:
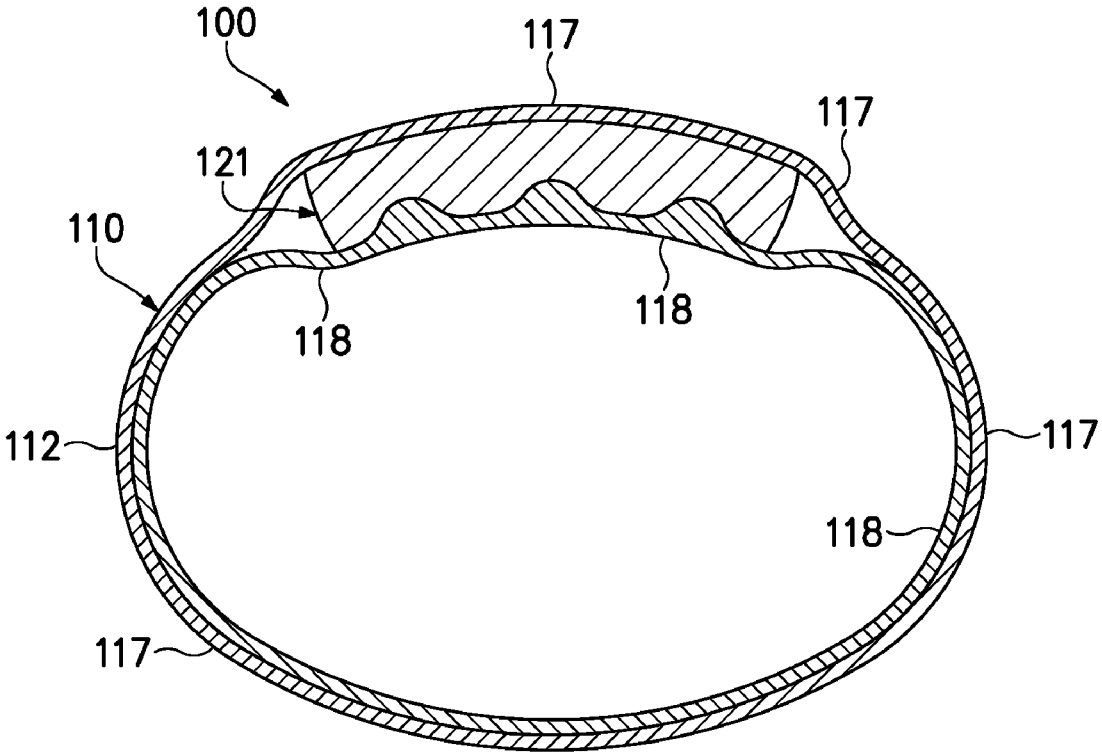

Fastening systems provide further structures that may be utilized to secure the positions of insert elements 121-126. More particularly, surfaces of insert elements 121-126 or layers 117 and 118 may incorporate portions of a fastening system that is utilized to secure insert elements 121-126 to apparel 110. A variety of fastening systems may be utilized, including hook-and-loop fastening systems (e.g., VELCRO, which is manufactured by VELCRO USA, Inc. of Manchester, N.H., United States of America), magnetic fastening systems, adhesive fastening systems, and button-type fastening systems, for example. In some configurations, the fastening system may be protrusions formed in either or both of layers 117 and 118 that mate with indentations in insert elements 121-126, or the fastening system may be indentations formed in either or both of layers 117 and 118 that mate with protrusions in insert elements 121-126. As an example, FIG. 5C depicts a configuration wherein inner layer 118 forms various protrusions that extend into indentations in one surface of insert element 121.

Although each of frictional resistance, compression forces, and a fastening system may be sufficient individually to secure the positions of insert elements 121-126, combinations of these methods may also be utilized. For example, the frictional resistance between insert elements 121-126 and layers 117 and 118 coupled with the compressive forces from outer layer 117 may be used in combination to secure the positions of insert elements 121-126. Similarly, a hook-and-loop fastening system coupled with the compressive forces from outer layer 117 may be used in combination to secure the positions of insert elements 121-126. Moreover, a combination of each of frictional resistance, compression forces, and a fastening system may be used in combination to secure the positions of insert elements 121-126.

Based upon the above discussion, apparel system 100 includes apparel 110 and one or more insert elements 121-126. Inner layer 117 and outer layer 118, which form apparel 110, are positioned adjacent to each other, with portions of layers 117 and 118 being unconnected. Insert elements 121-126 are locatable between layers 117 and 118. In various configurations, at least one of layers 117 and 118 are formed from a textile that stretches at least thirty percent prior to tensile failure, or layers 117 and 118 may unsecured to each other in at least fifty percent of apparel 110. In some configurations, a coefficient of static friction between apparel 110 (e.g., facing surfaces of layers 117 and 118) and one or more of insert elements 121-126 is at least 0.70.

Apparel Variations

Figure 6A:
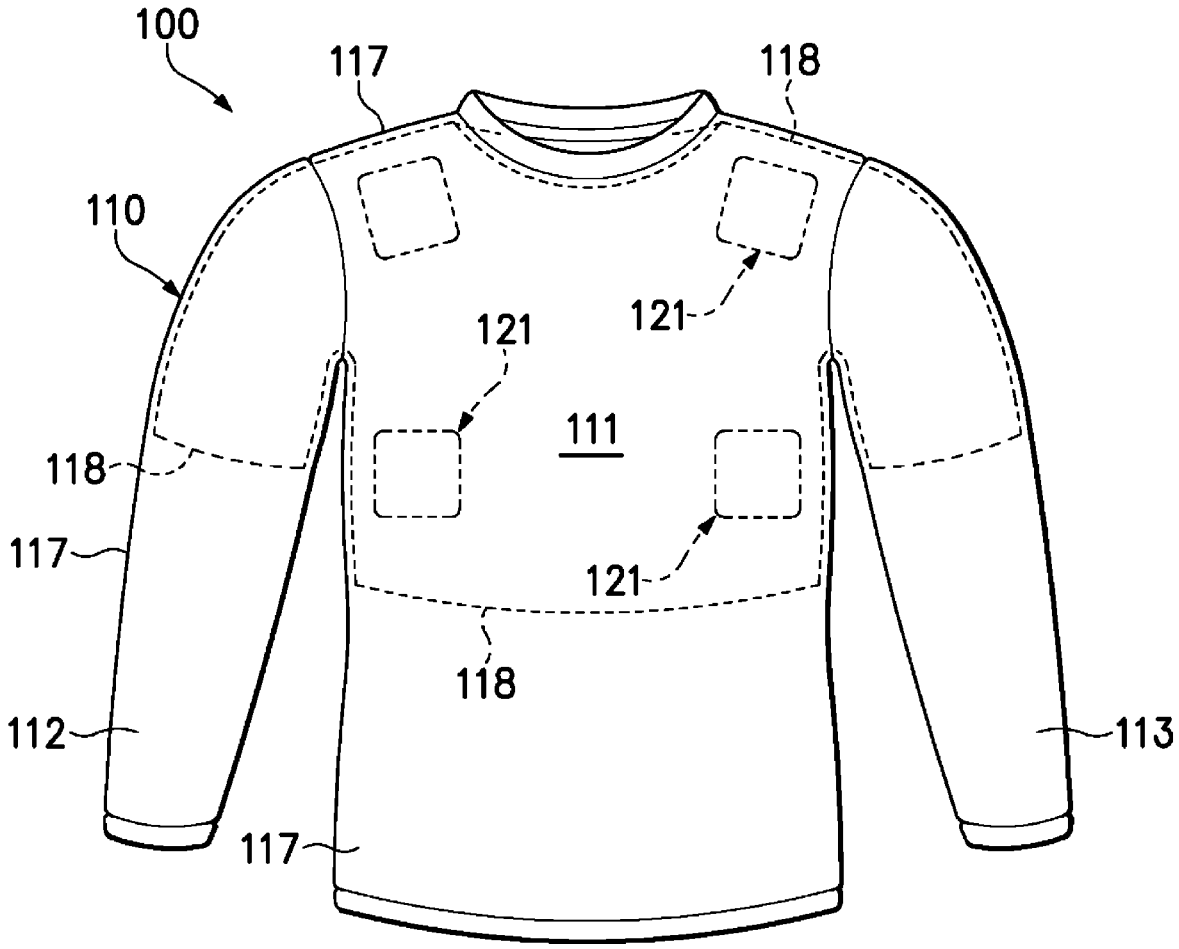
FIGS. 6A-6D are front elevational views of further configurations of the apparel system.
Figure 6B:
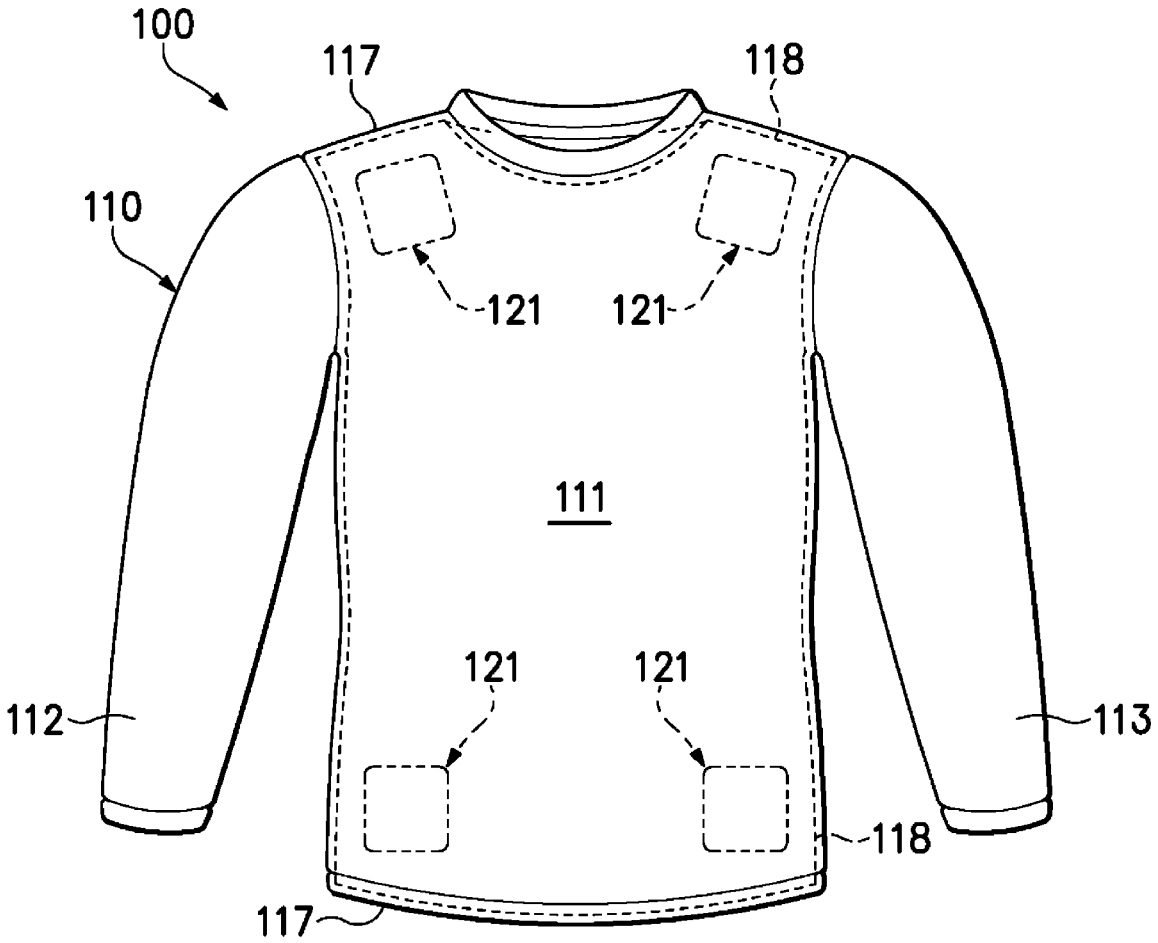
Figure 6C:
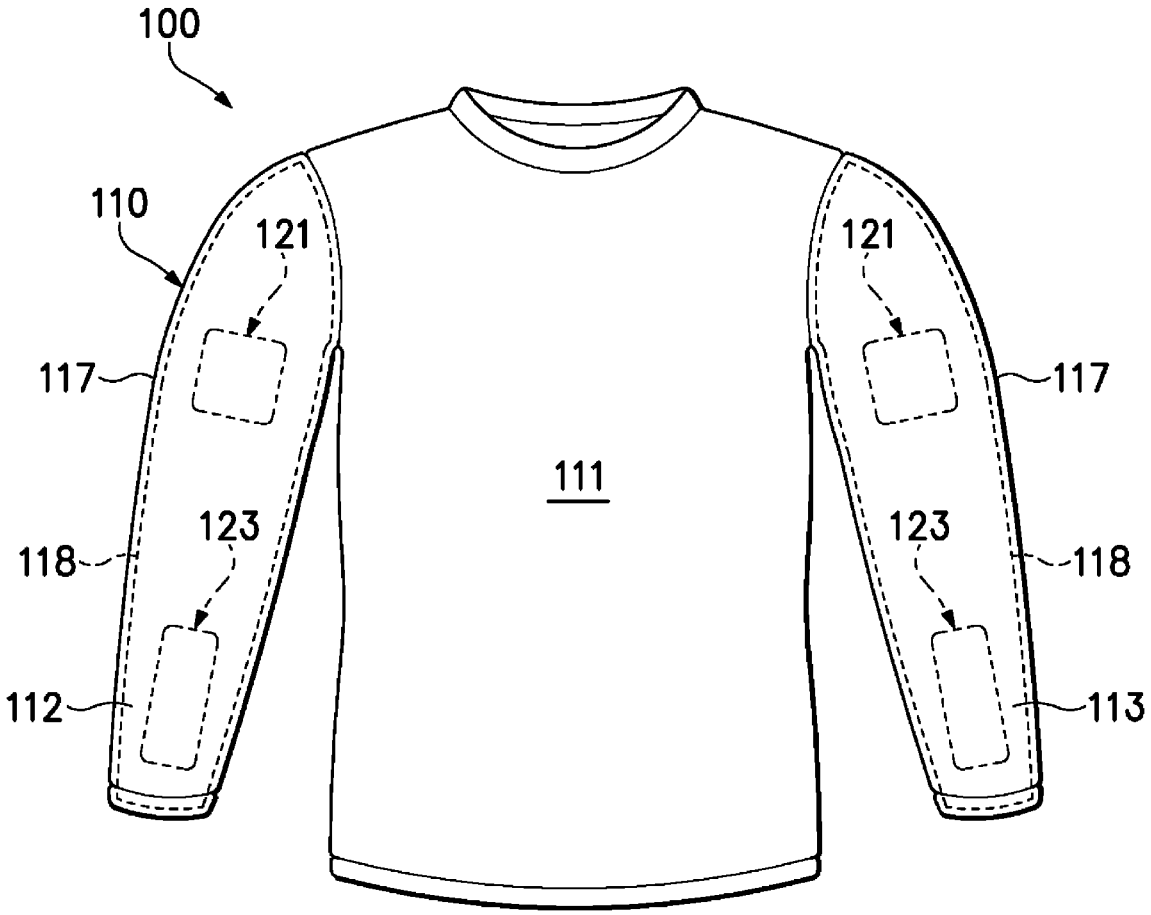
Figure 6D:
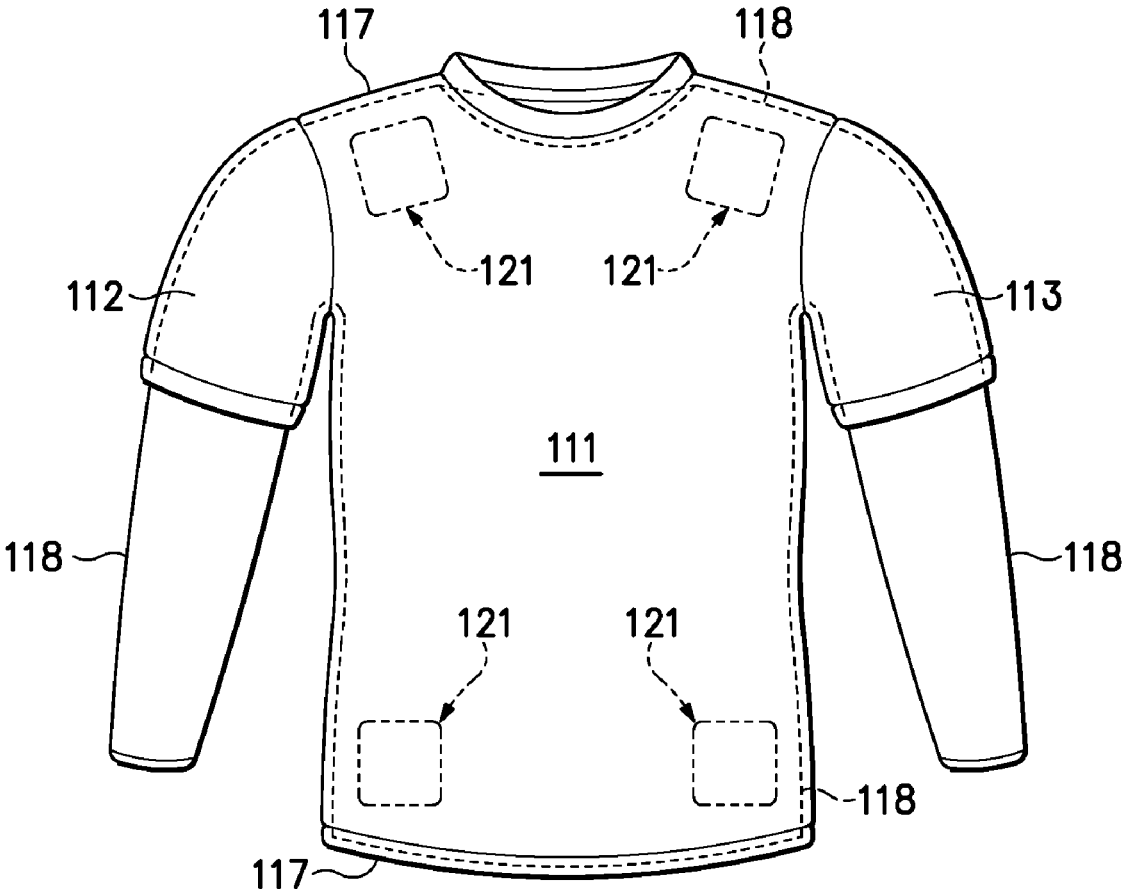

Apparel 110 has the configuration of a shirt-type garment, particularly a long-sleeved shirt. In general, shirt-type garments cover a portion of a torso of the wearer and may extend over arms of the wearer. In further configurations, apparel 110 may have the configuration of other shirt-type garments, including short-sleeved shirts, tank tops, undershirts, jackets, or coats. In addition to variations in the variety of shirt-type garment utilized for apparel 110, the relative locations of layers 117 and 118 may also vary. In the configuration of FIGS. 1-3, each of outer layer 117 and inner layer 118 extend through substantially all of regions 111-113, which permits insert elements 121-126 to be secured to any area of apparel 110. In some configurations, layers 117 and 118 may lay adjacent to each other in only a portion of apparel 110. As examples, a configuration wherein inner layer 118 is limited to an upper area of torso region 111 and upper areas of arm regions 112 and 113 is depicted in FIG. 6A, and a configuration wherein inner layer 118 is absent from arm regions 112 and 113 is depicted in FIG. 6B. In each of these configurations, layers 117 and 118 lay adjacent to each other in more than fifty percent of apparel 110. That is, a surface of inner layer 118 contacts a surface of outer layer 117 in at least fifty percent of apparel 110, which allows insert elements 121-126 to be widely distributed or located within apparel 110. In another configuration, which is depicted in FIG. 6C, inner layer 118 is only located in arm regions 112 and 113, wherein a surface of inner layer 118 contacts a surface of outer layer 117 in at least thirty percent of apparel 110. As a further example, FIG. 6D depicts a configuration wherein (a) outer layer 117 is absent in lower portions of arm regions 112 and 113, whereas inner layer 118 extends through each or regions 111-113. Accordingly, the relative areas covered by layers 117 and 118 may vary significantly. Note that apparel system 100 in each of FIGS. 6A-6D incorporates multiple insert elements 121, rather than the various insert elements 121-126.

Figure 7:
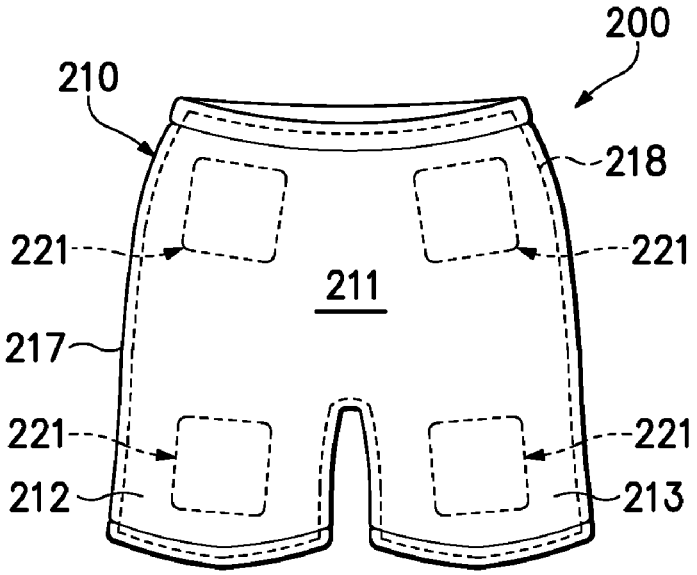
FIG. 7 is a front elevational view of another apparel system that includes an article of apparel and various insert elements.

The general structure and concepts discussed above relative to apparel 110 may also be applied to other types of apparel. Referring to FIG. 7, an apparel system 200 is depicted as having an article of apparel 210 with the configuration of a pants-type garment and a plurality of insert elements 221. Whereas various insert elements 121-126 with different shapes and sizes were depicted in association with apparel 110, multiple similar insert elements 221 are depicted in association with apparel 210. Insert elements 221 may be any of, for example, (a) foam members, gas-filled chambers, or plates, (b) liquid-filled chambers, or (c) electronic devices. Moreover, each of insert elements 221 may be removed from apparel 210 and positioned in different locations. Accordingly, each of insert elements 221 may be relocated depending upon the particular function of each of insert elements 221 and the desires, needs, or preferences of the wearer.

Apparel 210 includes a pelvic region 211 and a pair of leg regions 212 and 213 that extend outward from pelvic region 211. As with apparel 110, apparel 210 exhibits a two-layer configuration having an outer layer 217 and an adjacent inner layer 218 that extend through each of regions 211-213. Outer layer 217 forms an outer portion of apparel 210, and inner layer 218 forms an inner portion of apparel 210. Although outer layer 217 and inner layer 218 may be joined in various locations (e.g., through stitching), a majority of layers 217 and 218 are unconnected to each other and lay adjacent to each other, thereby defining areas for receiving insert elements 221. That is, insert elements 221 may be positioned between unconnected areas of layers 217 and 218 throughout apparel 210. More particularly, insert elements 221 may be joined to apparel 210 when placed between layers 217 and 218, and insert elements 221 may be located in any of pelvic region 211 and leg regions 212 and 213. As with apparel 110, a variety of materials may be utilized in manufacturing apparel 210, and apparel 210 may be intended for use as a compression garment.

Figure 8A:
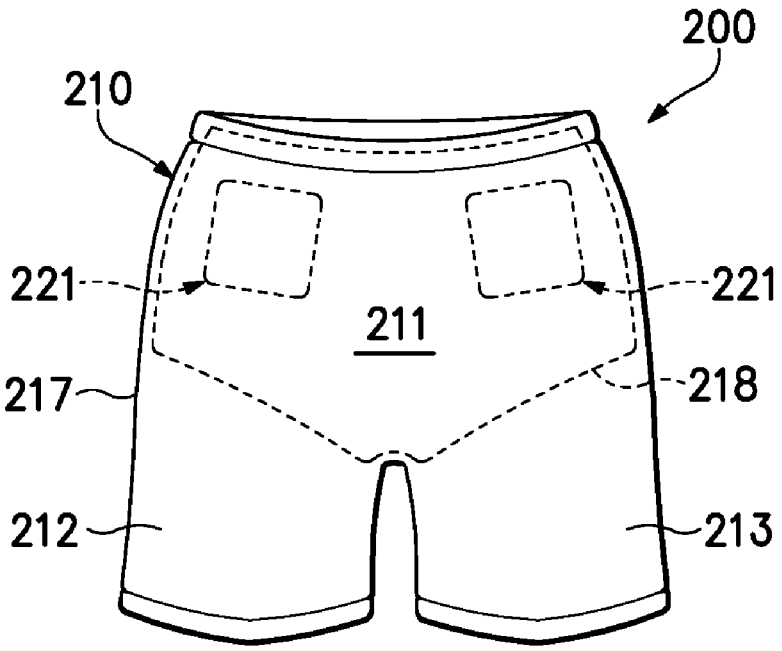
FIGS. 8A-8D are front elevational views of further configurations of the apparel system depicted in FIG. 7.
Figure 8B:
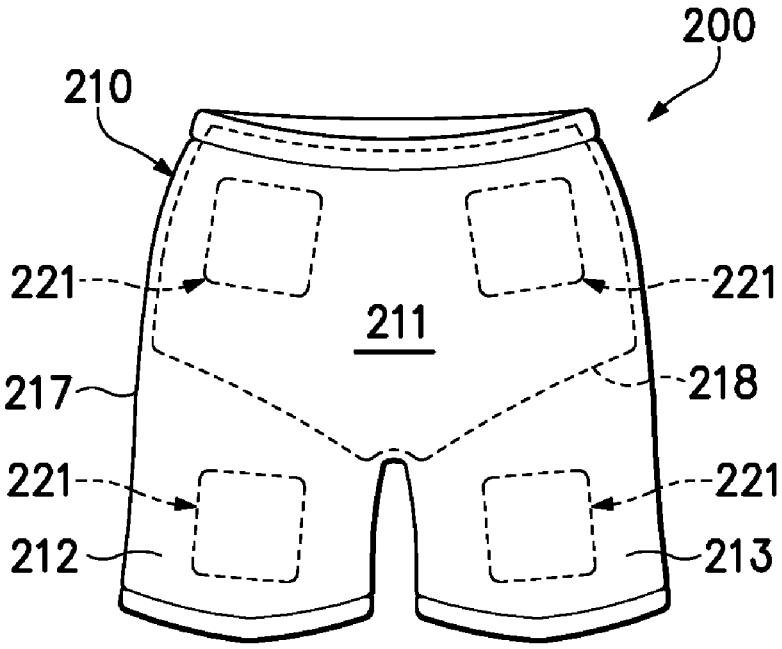
Figure 8C:
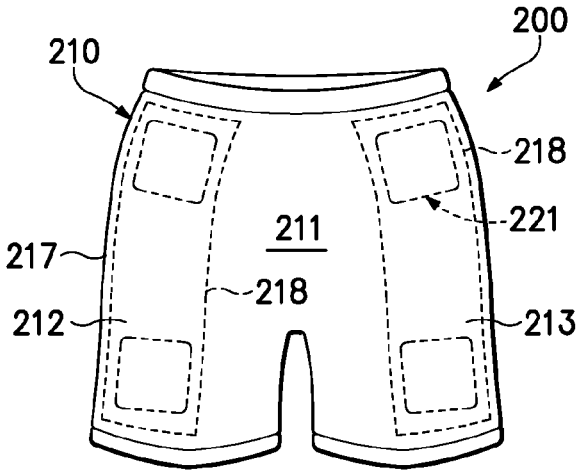
Figure 8D:
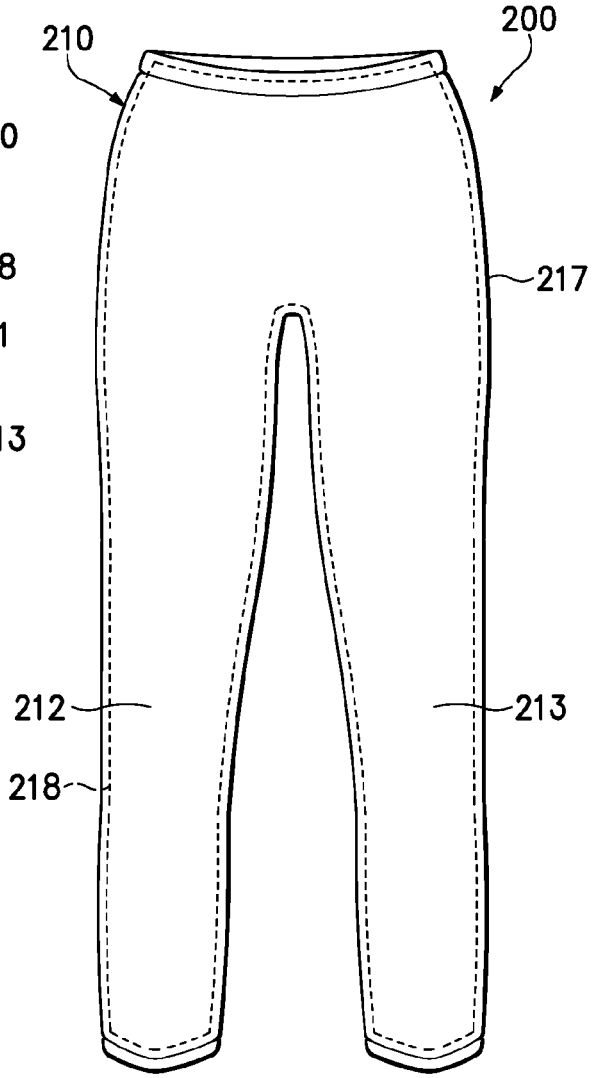

Apparel 210 has the configuration of a pants-type garment, particularly a pair of shorts. In general, pants-type garments cover a portion of a pelvic region of the wearer and may extend over legs of the wearer. In further configurations, apparel 210 may have the configuration of other pants-type garments, including pants, shorts, briefs, jeans, and underwear. In addition to variations in the variety of pants-type garment utilized for apparel 210, the relative locations of layers 217 and 218 may also vary. In the configuration of FIG. 7, each of outer layer 217 and inner layer 218 extend through substantially all of regions 211-213, which permits insert elements 221 to be secured to any area of apparel 210. In some configurations, layers 217 and 218 may lay adjacent to each other in only a portion of apparel 210. As an example, a configuration wherein inner layer 118 is limited to pelvic region 211 is depicted in FIG. 8A. In this configuration, a surface of inner layer 218 contacts a surface of outer layer 217 in at least fifty percent of apparel 210, which allows insert elements 221 to be widely distributed or located within apparel 210. Another configuration wherein inner layer 118 is limited to leg regions 212 and 213 is depicted in FIG. 8B, in which a surface of inner layer 218 contacts a surface of outer layer 217 in at least thirty percent of apparel 210. In another configuration, which is depicted in FIG. 8C, inner layer 218 extends through each of regions 211-213, but is limited to side areas of apparel 210. As a further example, FIG. 8D depicts a configuration wherein apparel 210 has the configuration of a pair of pants. Accordingly, the relative areas covered by layers 217 and 218 may vary significantly.

Insert Element Variations

Insert elements 121-126 and 221 may exhibit a variety of different configurations, depending upon the activities a wearer engages in and the desires, needs, or preferences of the wearer. As discussed above, insert elements 121-126 and 221 may be (a) foam members, gas-filled chambers, or plates, (b) liquid-filled chambers, or (c) electronic devices. Moreover, the shapes, sizes, and thicknesses, for example, of insert elements 121-126 and 221 may vary significantly. In general, however, each of insert elements 121-126 and 221 have a configuration that is locatable between layers 117 and 118 or between layers 217 and 218 in various locations and orientations.

Figure 10:
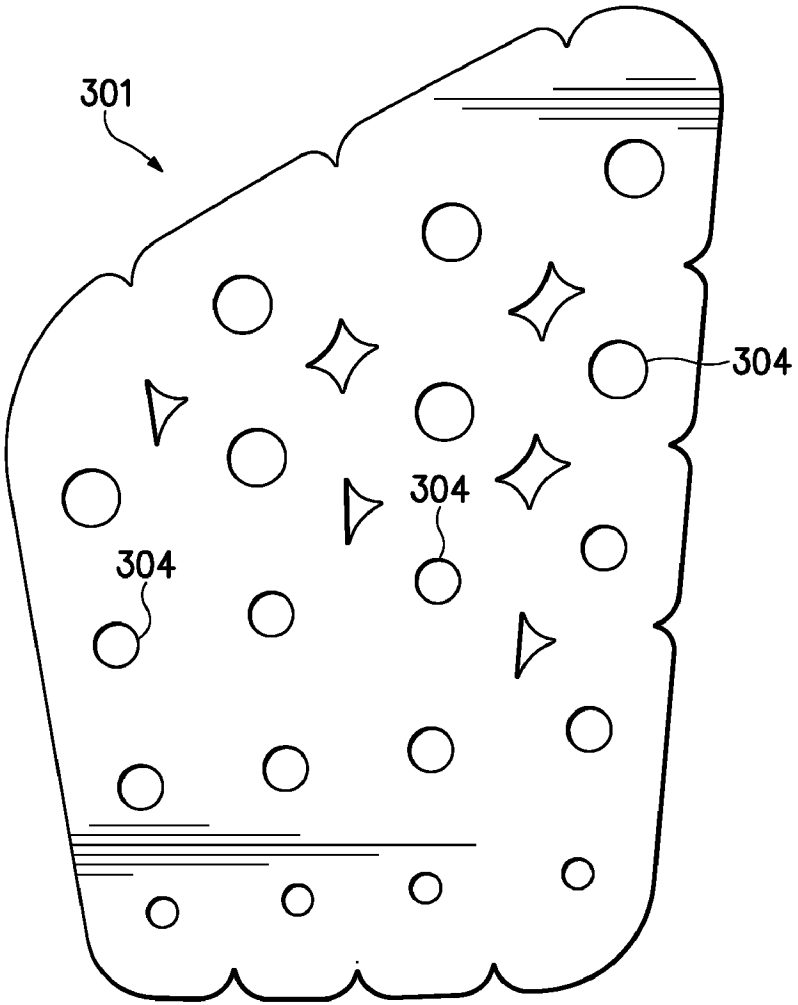
FIG. 10 is a bottom plan view of the first insert element.
Figure 9:
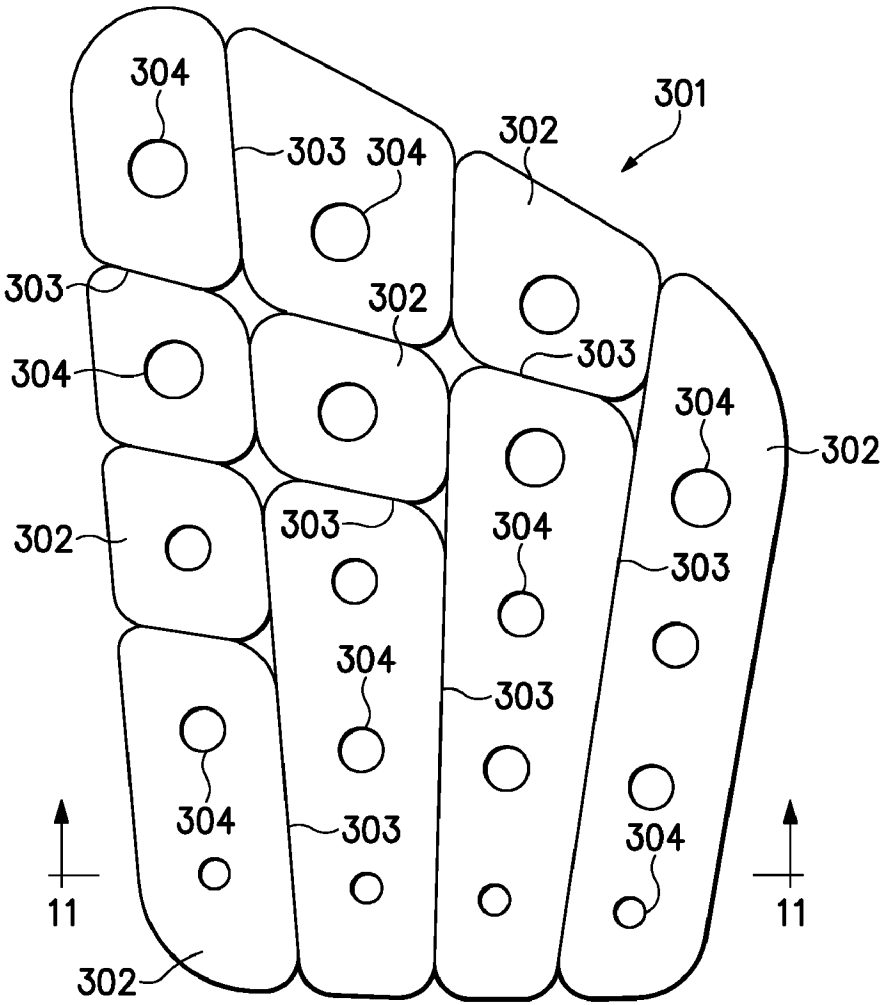
FIG. 9 is a top plan view of a first insert element.
Figure 11:
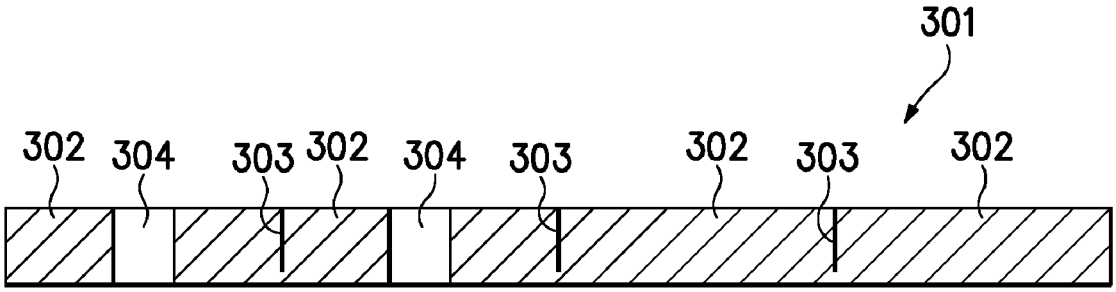
FIG. 11 is a cross-sectional view of the first insert element, as defined by section line 11-11 in FIG. 9.
Figure 12:
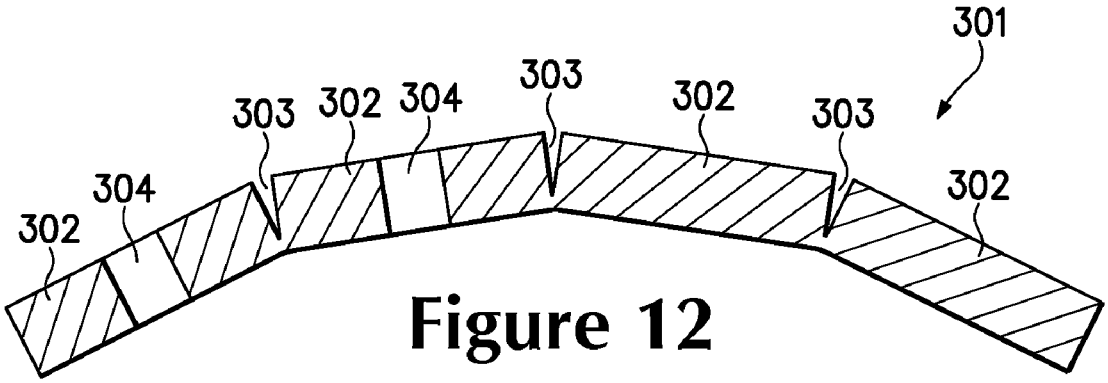
FIG. 12 is a cross-sectional view corresponding with FIG. 11 and depicting the first insert element in a flexed configuration.
Figure 13A:
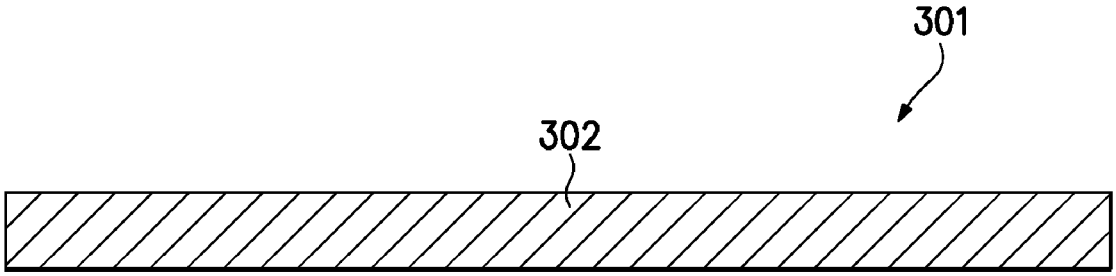
FIGS. 13A-13I are cross-sectional views corresponding with FIG. 11 and depicting further configurations of the first insert element.
Figure 13B:
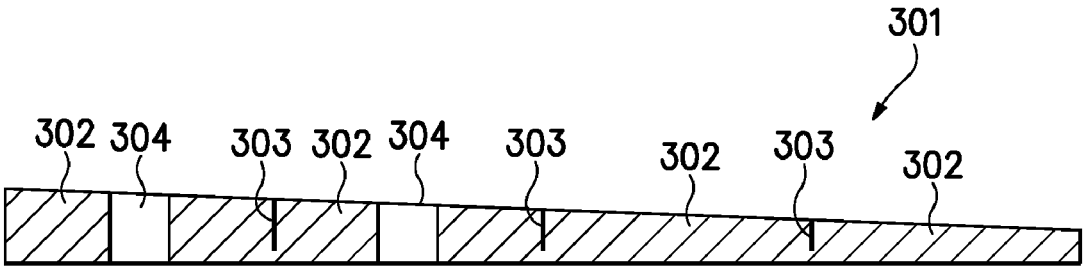

A further example of an insert element 301 is depicted in FIGS. 9-11 as including a plurality of portions 302 that are separated from each other by a plurality of incisions 303. Although a variety of materials may be utilized for insert element 301, polymer foam materials may attenuate compression forces (i.e., impart padding or cushioning) to provide impact protection. An advantage of incisions 303 is that the flex properties of insert element 301 are enhanced, thereby allowing insert element 301 to conform with the shape of the wearer. Referring to FIG. 12, insert element 301 is shown in a flexed configuration, wherein incisions 303 separate to provide flex grooves that permit insert element 301 to curve or otherwise bend. Some of portions 302 may also include an aperture 304, which enhances breathability and reduces the overall weight of insert element 301. A configuration of insert element 301 wherein incisions 303 and apertures 304 are absent is depicted in FIG. 13A, and a configuration wherein insert element 301 is tapered is depicted in FIG. 13B.

Figure 13C:
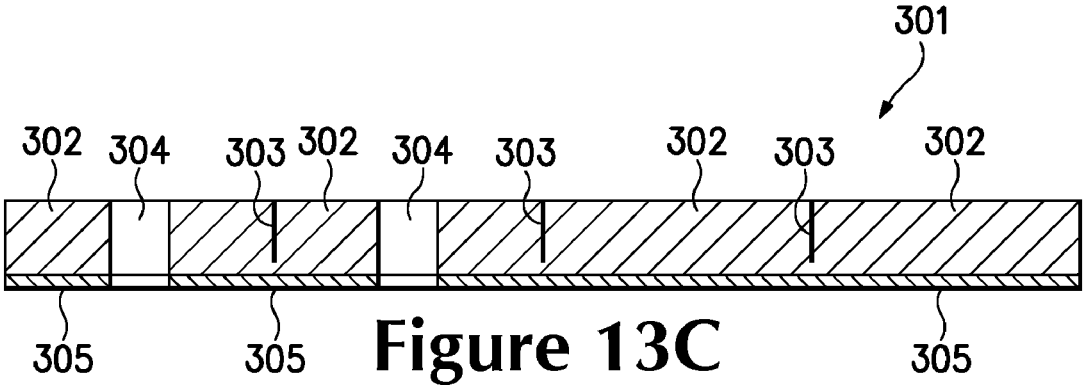
Figure 13D:
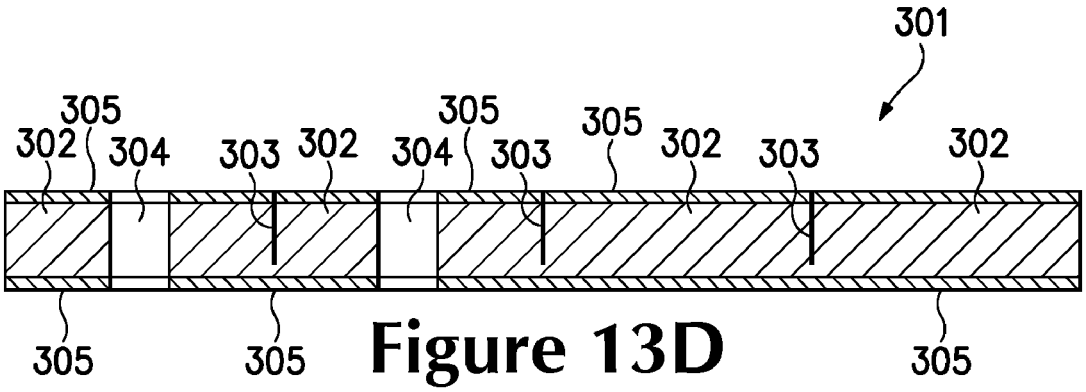
Figure 13E:
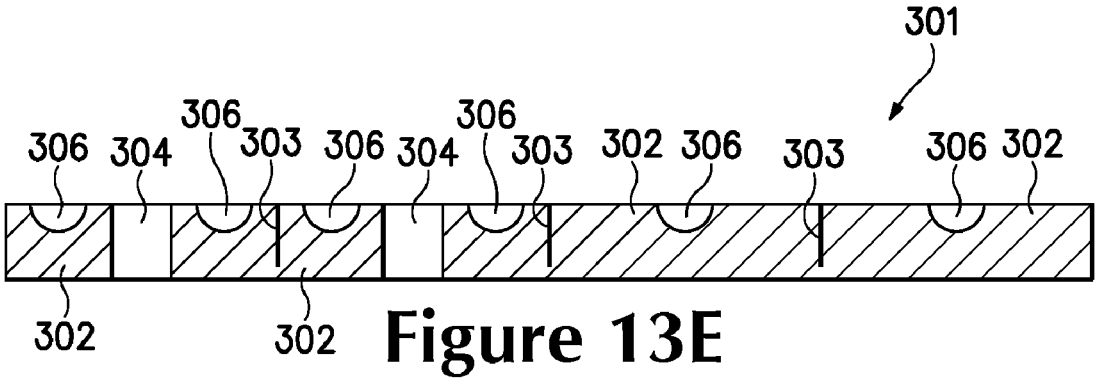
Figure 13F:
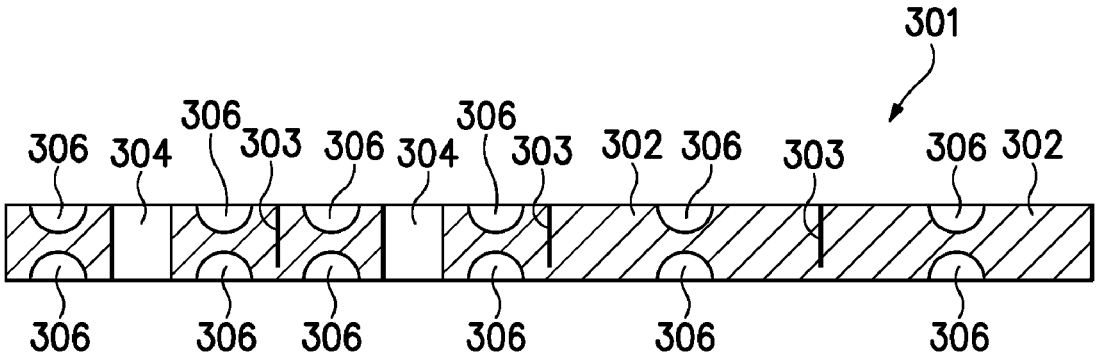
Figure 13G:
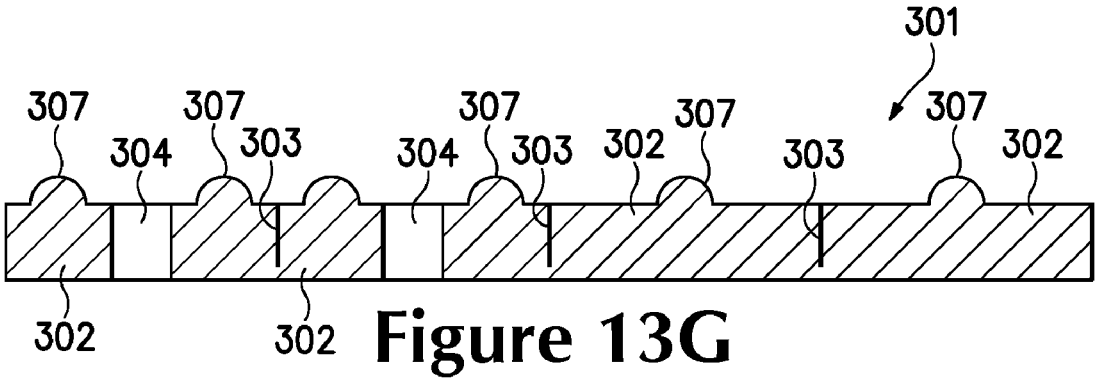
Figure 13H:
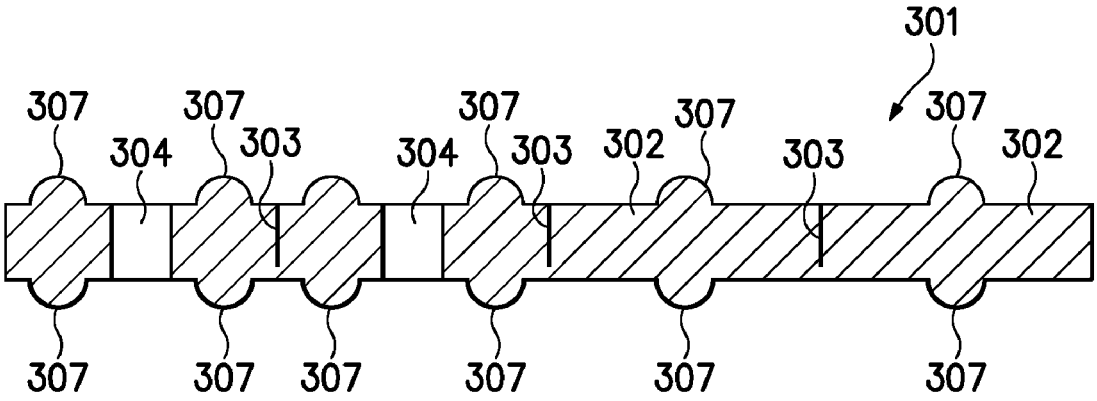
Figure 13I:
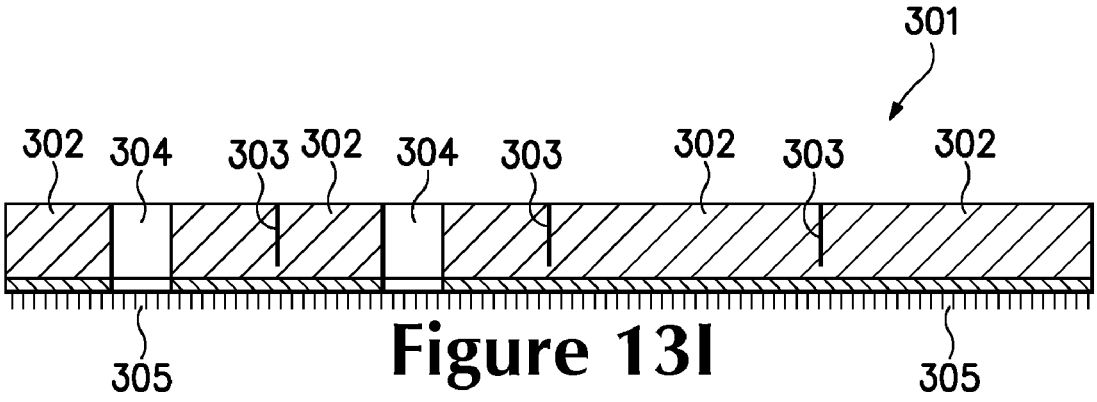

The configuration of insert element 301 may enhance the manner in which insert element 301 remains positioned or oriented when located within either of apparel 110 or apparel 210. Referring to FIG. 13C, a coating 305 (e.g., silicone or rubber) is applied to a lower surface of insert element 301. Coating 305 may be used to enhance the frictional resistance between insert element 301 and the materials of either of layers 117 and 118 or layers 217 and 218. A similar configuration is depicted in FIG. 13D, in which both surfaces of insert element 301 incorporate coating 305. As another manner of ensuring that insert element 301 remains positioned or oriented, one or both surfaces may incorporate various indentations 306, as depicted in FIGS. 13E and 13F, that mate with protrusions from layers 117 and 118 or layers 217 and 218. In further configurations, one or both surfaces may incorporate various protrusions 307, as depicted in FIGS. 13G and 13H, that extend into indentations in layers 117 and 118 or layers 217 and 218. Insert element 301 may also incorporate a coating with various protruding filaments 308, as depicted in FIG. 131, that extend into the textile materials of any of layers 117, 118, 217, or 218 to ensure that insert element 301 remains positioned.

Figure 14:
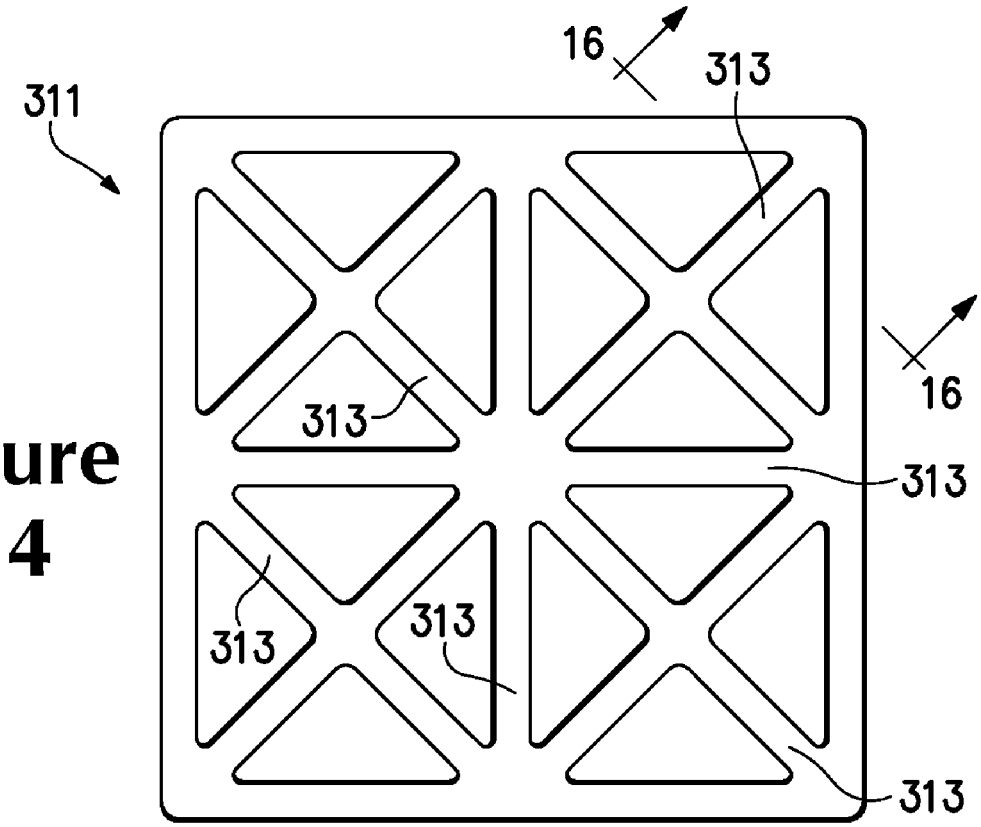
FIG. 14 is a top plan view of a second insert element.
Figure 15:
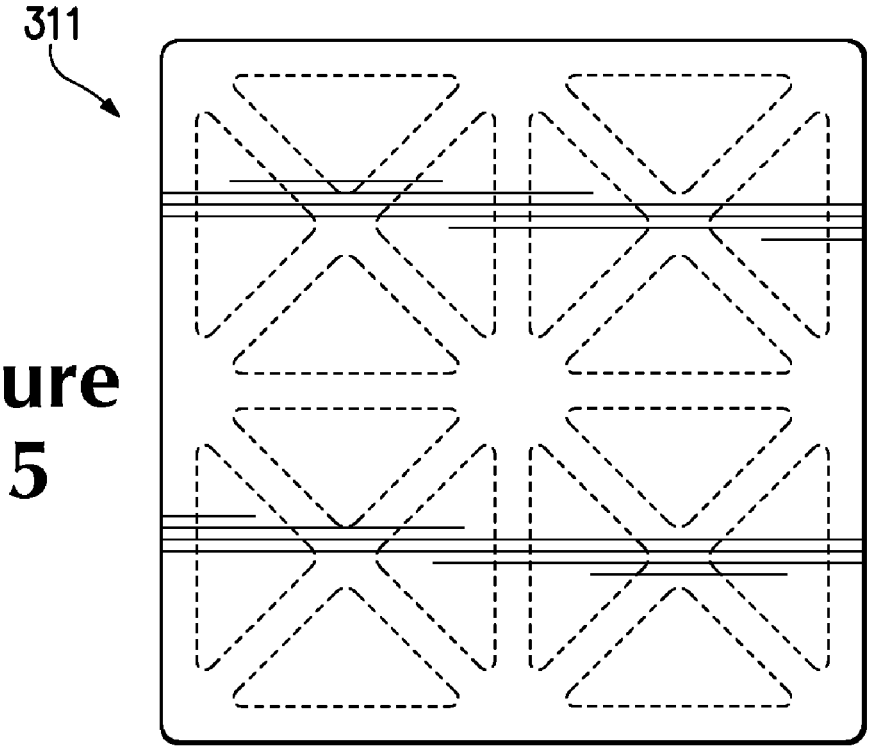
FIG. 15 is a bottom plan view of the second insert element.
Figure 16:
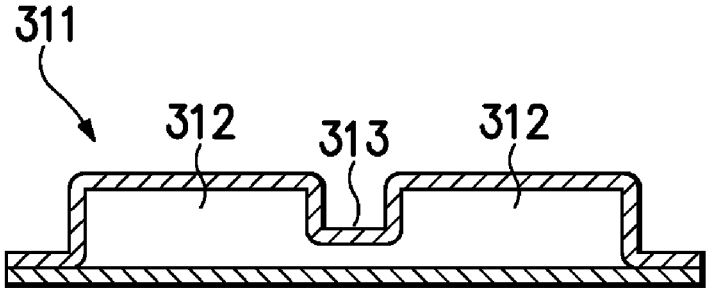
FIG. 16 is a cross-sectional view of the second insert element, as defined by section line 16-16 in FIG. 14.

Another example of an insert element 311 is depicted in FIGS. 14-16 as having the configuration of a fluid-filled chamber, which may enclose either a gas or a liquid. Insert element 311 may be formed from a polymer material that defines an interior void 312 for receiving the fluid. When void 312 includes a gas, such as a pressurized gas, insert element 311 may be utilized to attenuate compression forces. That is, insert element 311 may be utilized to impart protection to specific areas of the wearer. When a liquid is located within void 312, the liquid may be utilized to impart heating or cooling to areas of the wearer where insert element 311 is located. More particularly, insert element 311 and the liquid within insert element 311 may be heated or cooled. Once located (a) between layers 117 and 118 or between layers 217 and 218 and (b) adjacent to a specific area of the wearer, insert element 311 and the liquid within insert element 311 may impart heat to or draw heat away from the wearer. In some configurations, insert element 311 may include an opening that permits the wearer to locate a liquid within void 312 or drain the liquid from void 312.

Figure 17A:
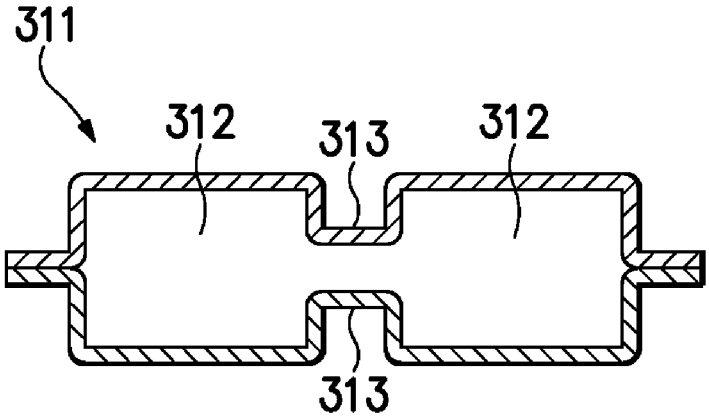
FIGS. 17A-17C are cross-sectional views corresponding with FIG. 16 and depicting further configurations of the second insert element.

One surface of insert element 311 defines a plurality of indentations 313 that enhance the flex properties of insert element 311. As with incisions 303 in insert element 301, indentations 313 provide flex grooves that permit insert element 311 to curve or otherwise bend, thereby conforming with the shape of the wearer. Indentations 313 may also receive protrusions formed on any of layers 117, 118, 217, or 218 to enhance the manner in which insert element 311 remains positioned or oriented when located within either of apparel 110 or apparel 210. In some configurations, as depicted in FIG. 17A, both surfaces of insert element 311 may define indentations 313.

The polymer material forming insert element 311 may provide sufficient friction with layers 117, 118, 217, and 218 to ensure that insert element 311 remains positioned. Various surface treatments (e.g., plasma treating, texturing) may be used to enhance the friction properties of insert element 311.

Figure 17B:
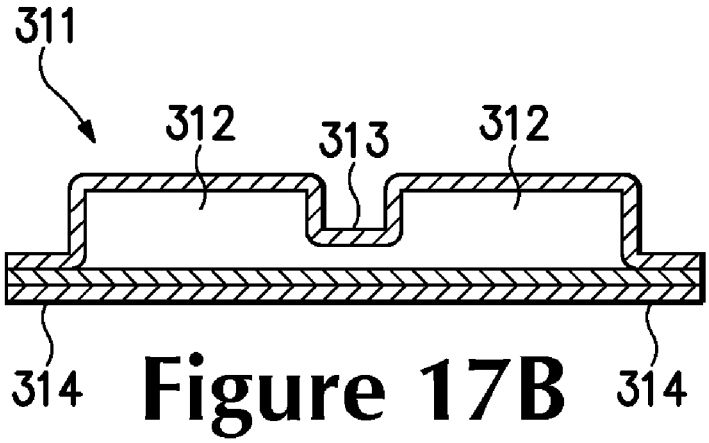
Figure 17C:
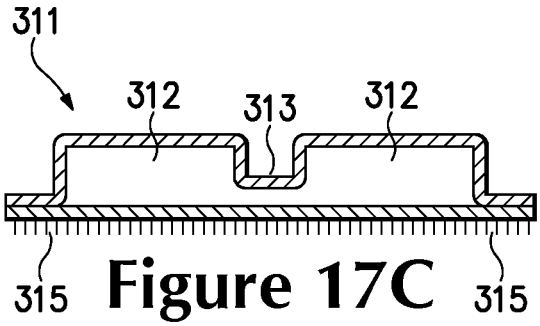

Additionally, a coating 314 may be applied to one surface of insert element 311, as depicted in FIG. 17B, or coating 314 may be applied to both surfaces. Insert element 311 may also incorporate a coating with various protruding filaments 315, as depicted in FIG. 17C, that extend into the textile materials of either of layers 117, 118, 217, or 218 to ensure that insert element 311 remains positioned.

Figure 18:
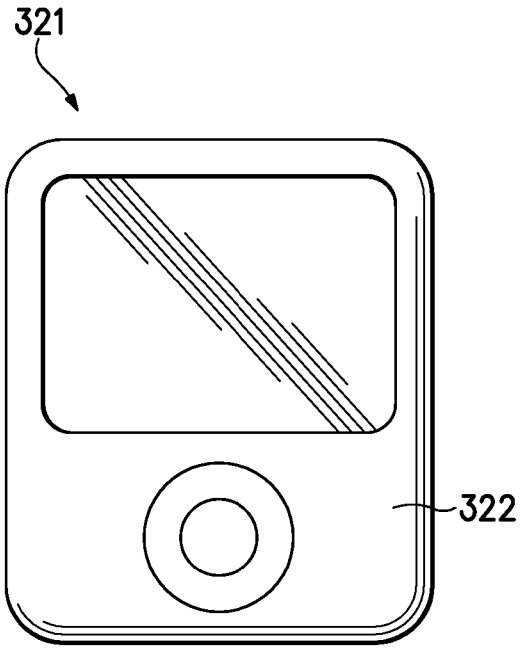
FIG. 18 is a top plan view of a third insert element.
Figure 19:
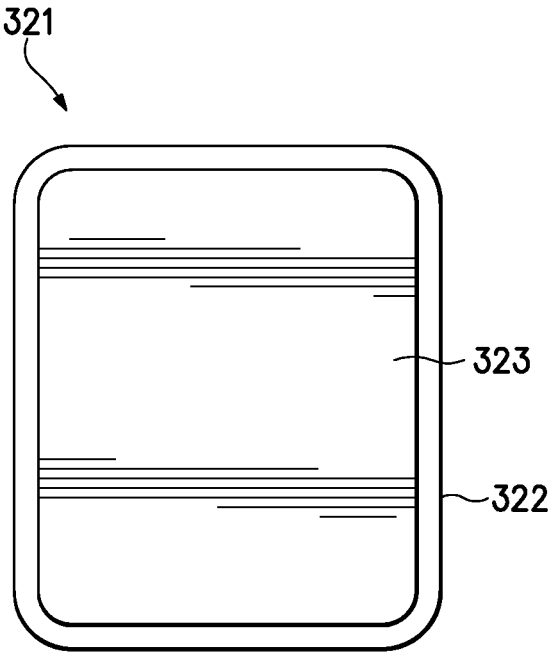
FIG. 19 is a bottom plan view of the third insert element.

A further example of an insert element 321 is depicted in FIGS. 18 and 19 as having including an electronic device 322 and a coating 323. Although electronic device 322 may be formed from a variety of materials, many polymer materials may not provide sufficient friction against layers 117, 118, 217, and 218. In order to enhance the friction properties of electronic device 322, coating 323 is applied to at least one surface. Various surface treatments (e.g., plasma treating, texturing) may also be used to enhance the friction properties of insert element 311.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An apparel system comprising:

an article of apparel including an inner layer and an outer layer positioned adjacent to the inner layer such that a surface of the inner layer contacts a surface of the outer layer in an unconnected area, the outer layer being formed from a textile that stretches at least thirty percent prior to tensile failure; and a plurality of separate chambers configured to receive a fluid, the chamber being removably located in one of a plurality of different locations within the unconnected area, wherein the plurality of chambers are located in a common unconnected area and each of the plurality of chambers contacts both the inner layer and the outer layer of the article of apparel;

wherein at least one of the surface of the inner layer and the surface of the outer layer of the article of apparel includes protrusions and at least one of the chambers includes indentations, or at least one of the surface of the inner layer and the surface of the outer layer of the article of apparel includes indentations and at least one of the chambers includes protrusions;

wherein the protrusions mate with the indentations.

2. The apparel system recited in claim 1, wherein the inner layer is formed from a textile that stretches at least thirty percent prior to tensile failure.

3. The apparel system recited in claim 1, wherein the textile of the outer layer is substantially identical to the textile of the inner layer.

4. The apparel system recited in claim 1, wherein the article of apparel is one of:

a shirt-type garment-type garment having a torso region and a pair of arm regions extending outward from the torso region; and a pants-type garment having a pelvic region and a pair of leg regions extending outward from the pelvic region.

5. The apparel system recited in claim 1, wherein a coefficient of static friction between an exterior surface of a chamber of the plurality of chambers and at least one of the surface of the inner layer and the surface of the outer layer is at least 0.70.

6. The apparel system recited in claim 5, wherein at least one of the surface of the inner layer, the surface of the outer layer, and an exterior surface of the chamber incorporates at least one of a rubber and a silicone material.

7. The apparel system recited in claim 1, wherein the unconnected area comprises at least thirty percent of the article of apparel.

8. The apparel system recited in claim 1, wherein the unconnected area comprises at least fifty percent of the article of apparel.

9. The apparel system recited in claim 1, wherein a liquid is sealed within the chamber.

10. The apparel system recited in claim 1, wherein no joint joining the inner layer and the outer is present between plurality of chambers located in a common unconnected area.

11. The apparel system recited in claim 1, wherein the plurality of chambers enclose a pressurized fluid.

12. An apparel system comprising:

an article of apparel including an inner layer and an outer layer positioned adjacent to the inner layer such that a surface of the inner layer contacts a surface of the outer layer, the inner layer and the outer layer being formed from textiles that stretch at least thirty percent prior to tensile failure; and an insert element that is locatable between the inner layer and the outer layer, the insert element having an exterior surface, a coefficient of static friction between the exterior surface and at least one of the surface of the inner layer and the surface of the outer layer being at least 0.70;

wherein at least one of the surface of the inner layer and the surface of the outer layer of the article of apparel includes protrusions and the insert element includes indentations, or at least one of the surface of the inner layer and the surface of the outer layer of the article of apparel includes indentations and the insert element includes protrusions;

wherein the protrusions mate with the indentations.

13. The apparel system recited in claim 12, wherein the article of apparel is one of:

a shirt-type garment-type garment having a torso region and a pair of arm regions extending outward from the torso region; and a pants-type garment having a pelvic region and a pair of leg regions extending outward from the pelvic region.

14. The apparel system recited in claim 12, wherein the surface of the inner layer contacts the surface of the outer layer in at least thirty percent of the article of apparel.

15. The apparel system recited in claim 12, wherein the surface of the inner layer contacts the surface of the outer layer in at least fifty percent of the article of apparel.

16. The apparel system recited in claim 12, wherein the insert element is a chamber and a liquid is sealed within the chamber.

17. The apparel system recited in claim 12, wherein at least one of the surface of the inner layer, the surface of the outer layer, and the exterior surface of the insert element incorporates at least one of a rubber and a silicone material.

18. The apparel system recited in claim 12, wherein the exterior surface of the insert element and at least one of the surface of the inner layer and the surface of the outer layer incorporate corresponding protrusions and indentations.

19. The apparel system recited in claim 12, wherein the insert element encloses a pressurized fluid.

20. The apparel system recited in claim 12, wherein at least one of the surface of the inner layer, the surface of the outer layer, and the exterior surface of the insert element includes a coating that provides the coefficient of static friction between the exterior surface and at least one of the surface of the inner layer and the surface of the outer layer of at least 0.70.

21. The apparel system recited in claim 20, wherein the coating includes at least one of a rubber and a silicone material.

22. An apparel system comprising:

an article of apparel including an inner layer and an outer layer positioned adjacent to the inner layer, the inner layer being joined to the outer layer such that a surface of the inner layer contacts and is unsecured to a surface of the outer layer in an unconnected portion that is at least fifty percent of the article of apparel, the inner layer and the outer layer being formed from textiles that stretch at least thirty percent prior to tensile failure; and a first insert element and a separate second insert element, the insert elements chamber being locatable between the inner layer and the outer layer, and each of the insert elements having an exterior surface, a coefficient of static friction between the exterior surface and at least one of the surface of the inner layer and the surface of the outer layer being at least 0.70;

wherein the unconnected portion is large enough to contain the first insert element and the second insert element;

wherein at least one of the surface of the inner layer and the surface of the outer layer of the article of apparel includes protrusions and at least one of the exterior surfaces of the first insert element and the second insert element includes indentations, or at least one of the surface of the inner layer and the surface of the outer layer of the article of apparel includes indentations and at least one of the exterior surfaces of the first insert element and the second insert element includes protrusions;

wherein the protrusions mate with the indentations.

23. The apparel system recited in claim 22, wherein at least one of the surface of the inner layer, the surface of the outer layer, and at least one of the exterior surfaces of the first insert element and the second insert element incorporates at least one of a rubber and a silicone material.

24. The apparel system recited in claim 22, wherein the first and second insert elements each enclose element encloses a pressurized fluid.

25. The apparel system recited in claim 22, wherein at least one of the surface of the inner layer, the surface of the outer layer, and the exterior surfaces of the insert elements includes a coating that provides the coefficient of static friction between the exterior surfaces and at least one of the surface of the inner layer and the surface of the outer layer of at least 0.70.

26. The apparel system recited in claim 25, wherein the coating includes at least one of a rubber and a silicone material.

* * * * *

UNITED STATES PATENT AND TRADEMARK OFFICE

CERTIFICATE OF CORRECTION

PATENT NO. : 8,256,034 B2
APPLICATION NO. : 12/184668
DATED : September 4, 2012
INVENTOR(S) : William E. Berner, Jr. et al.

It is certified that error appears in the above-identified patent and that said Letters Patent is hereby corrected as shown below:

Title Page in Item (75) Inventors, change "Sokolowaki" to --Sokolowski--.

Signed and Sealed this
Twenty-seventh Day of November, 2012

David J. Kappos

David J. Kappos
*Director of the United States Patent and Trademark Office*